US010820133B2

(12) United States Patent
Zhang

(10) Patent No.: US 10,820,133 B2
(45) **Date of Patent: *Oct. 27, 2020**

(54) METHODS AND SYSTEMS FOR EXTRACTING LOCATION-DIFFUSED SOUND

(71) Applicant: Verizon Patent and Licensing Inc., Arlington, VA (US)

(72) Inventor: Zhiguang Eric Zhang, Somerville, NJ (US)

(73) Assignee: Verizon Patent and Licensing Inc., Basking Ridge, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/777,922

(22) Filed: Jan. 31, 2020

(65) Prior Publication Data

US 2020/0169826 A1 May 28, 2020

Related U.S. Application Data

(63) Continuation of application No. 15/851,503, filed on Dec. 21, 2017, now Pat. No. 10,595,146.

(51) Int. Cl.
*H04R 5/027* (2006.01)
*H04R 3/04* (2006.01)
(Continued)

(52) U.S. Cl.
CPC ..... *H04S 7/303* (2013.01); *H04R 1/406* (2013.01); *H04R 3/005* (2013.01); *H04R 3/04* (2013.01);
(Continued)

(58) Field of Classification Search
CPC ..... H04R 1/406; H04R 2201/401; H04R 2420/01; H04R 29/005; H04R 3/005;
(Continued)

(56) References Cited

U.S. PATENT DOCUMENTS 6,021,206 A 2/2000 McGrath
8,744,101 B1 * 6/2014 Burns ..... H04R 25/407 381/23.1
(Continued)

OTHER PUBLICATIONS

Pulkki, et al., "Applications of Directional Audio Coding in Audio", Lab. Acoustics and Audio Signal Processing, Helsinki University of Tech., POBox 3000, FI-02015, Finland. 19th International Congress on Acoustics, Madrid, Sep. 2-7, 2007.

*Primary Examiner* — Vivian C Chin
*Assistant Examiner* — Friedrich Fahnert

(57) ABSTRACT

An exemplary sound extraction system generates an averaged set of audio signals by averaging values derived from different audio signals. For example, the sound extraction system generates an averaged set of audio signals by averaging values derived from a first set of audio signals captured at a particular location with respect to a capture zone, and values derived from a second set of audio signals captured at different locations with respect to the capture zone. Based on the averaged set of audio signals, the sound extraction system generates a location-diffused signal representative of sound in the capture zone. Corresponding systems and methods are also disclosed.

20 Claims, 13 Drawing Sheets

(51) Int. Cl.

| | |
|---|---|
| ***H04S 3/00*** | (2006.01) |
| ***H04S 7/00*** | (2006.01) |
| ***H04R 1/40*** | (2006.01) |
| ***H04R 29/00*** | (2006.01) |
| ***H04R 3/00*** | (2006.01) |

(52) U.S. Cl.
CPC ..... *H04R 5/027* (2013.01); *H04R 29/005* (2013.01); *H04S 3/00* (2013.01); *H04R 2201/401* (2013.01); *H04R 2420/01* (2013.01); *H04S 2400/15* (2013.01); *H04S 2420/11* (2013.01)

(58) Field of Classification Search
CPC ..... H04R 3/04; H04R 5/027; H04S 2400/15; H04S 2420/11; H04S 3/00; H04S 7/303
USPC ..... 381/17, 22, 23, 26, 57, 60, 91, 92, 122, 381/170, 300, 310
See application file for complete search history.

(56) References Cited

U.S. PATENT DOCUMENTS

| | | | | |
|---|---|---|---|---|
| 2010/0316233 | A1 | 12/2010 | Nam et al. | |
| 2011/0305344 | A1 | 12/2011 | Sole et al. | |
| 2013/0216070 | A1 | 8/2013 | Keiler et al. | |
| 2014/0355769 | A1 | 12/2014 | Peters et al. | |
| 2015/0098572 | A1 | 4/2015 | Krueger et al. | |
| 2016/0192102 | A1* | 6/2016 | Estrada | H04R 5/027 381/26 |
| 2016/0227337 | A1 | 8/2016 | Goodwin et al. | |
| 2017/0195815 | A1 | 7/2017 | Christoph et al. | |
| 2018/0352360 | A1 | 12/2018 | Chen et al. | |
| 2019/0098425 | A1* | 3/2019 | Habets | H04R 5/027 |

* cited by examiner

METHODS AND SYSTEMS FOR EXTRACTING LOCATION-DIFFUSED SOUND

RELATED APPLICATIONS

This application is a continuation application of U.S. patent application Ser. No. 15/851,503, filed Dec. 21, 2017, and entitled "Methods and Systems for Extracting Location-Diffused Ambient Sound from a Real-World Scene," which is hereby incorporated by reference in its entirety.

BACKGROUND INFORMATION

Background noise and other types of ambient sound are practically always present in the world around us. In other words, even when no primary sound (e.g., a person talking, music or other multimedia playback, etc.) is present at a particular location, various background noises and other ambient sounds may still be heard at the location.

Accordingly, in various applications in which real-world sounds or artificial sounds replicating real-world sounds are presented, it may be desirable to represent and/or replicate ambient sound in addition to representing and/or replicating primary sounds. For example, media programs presented using technologies such as virtual reality, television, film, radio, and so forth, may employ ambient sound to fill silences during the media programs and/or to otherwise add ambiance and realism to the media programs. Similarly, ambient sound may be useful in other applications such as calling systems (e.g., telephone systems, conferencing systems, video calling systems, etc.) to indicate that a call is still ongoing even if no party on the call is currently talking or otherwise providing primary sounds. In order to use ambient sound to maximum effect in these and various other types of applications employing ambient sound, it may be desirable to extract (e.g., capture, detect, record, etc.) ambient sound from the real world.

BRIEF DESCRIPTION OF THE DRAWINGS

The accompanying drawings illustrate various embodiments and are a part of the specification. The illustrated embodiments are merely examples and do not limit the scope of the disclosure. Throughout the drawings, identical or similar reference numbers designate identical or similar elements.

DETAILED DESCRIPTION OF PREFERRED EMBODIMENTS

Figure 1:
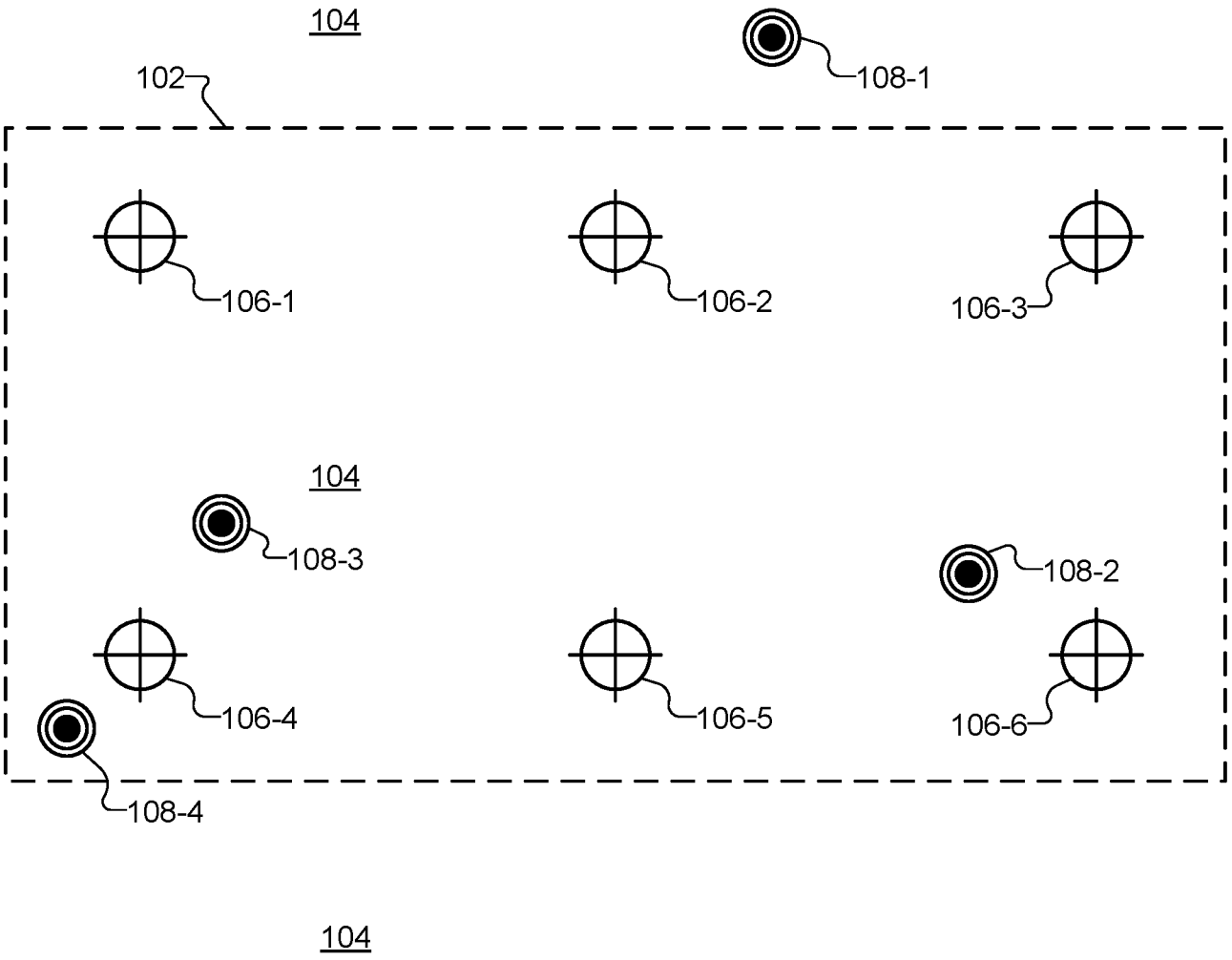
FIGS. 1-2 illustrate exemplary capture zones of a real-world scene from which ambient sound may be extracted according to principles described herein.

Systems and methods for extracting location-diffused ambient sound from a real-world scene are described herein. For example, as will be described in more detail below, certain implementations of an ambient sound extraction system may access a location-confined A-format signal from a multi-capsule microphone (e.g., a full-sphere multi-capsule microphone) disposed at a first location with respect to a capture zone of a real-world scene. The location-confined A-format signal may include a first set of audio signals captured by different capsules of the multi-capsule microphone. The ambient sound extraction system may further access a second set of audio signals from a plurality of microphones (e.g., single-capsule microphones) disposed at a plurality of other locations with respect to the capture zone that are distinct from the first location. For example, the ambient sound extraction system may access both the location-confined A-format signal (which includes the first set of audio signals) and the second set of signals by capturing the signals directly (e.g., using microphones integrated into the ambient sound extraction system), by receiving them from the respective microphones that capture the signals, by downloading or otherwise accessing them from a storage facility where the signals are stored, or in any other way as may serve a particular implementation.

Once the first and second sets of audio signals have been accessed and are available to the ambient sound extraction system, the ambient sound extraction system may generate a location-diffused A-format signal that includes a third set of audio signals that is based on the first and second sets of audio signals. For example, as will be described and illustrated below, each of the audio signals captured in the first and second sets of audio signals may be "location-confined" in the sense that they are associated only with one location (i.e., the location at which the microphone capsule that captured the signals was located when capturing the signals). However, the ambient sound extraction system may merge or combine information from the second set of audio signals (i.e., the signals captured at the various other locations distinct from the location of the multi-capsule microphone) into each of the first set of audio signals in the location-confined A-format signal captured by the multi-capsule microphone. In this way, an A-format signal may be generated that is "location-diffused" in the sense that it incorporates sound captured at multiple locations in the capture zone.

Based on the location-diffused A-format signal, the ambient sound extraction system may generate a location-diffused B-format signal representative of ambient sound in the capture zone. When decoded and rendered (e.g., converted for a particular speaker configuration and played back or otherwise presented to a user by way of the particular speaker configuration), a B-format signal may be manipulated so as to replicate not only a sound that has been captured, but also a direction from which the sound originated. In other words, as will be described in more detail below, the B-format signal includes sound and directionality information such that the B-format signal may be decoded and rendered to provide full-sphere surround sound to a listener. As such, the location-diffused B-format signal generated by the ambient sound extraction system may be employed in any of various applications. For example, as will be described in more detail below, the location-diffused B-format signal may be used to provide a location-diffused, ambient surround sound channel for use with virtual reality media content based on the capture zone of the real-world scene.

Methods and systems for extracting location-diffused ambient sound from a real-world scene may provide various benefits to providers and users of media content such as virtual reality media content. Virtual reality media content may be configured to allow users to look around in any direction (e.g., up, down, left, right, forward, backward) and, in certain examples, to also move around freely to various parts of an immersive virtual reality world. As such, when ambient sound channels extracted in accordance with the methods and systems described herein are presented to a virtual reality user (e.g., contemporaneously with primary sounds such as people speaking in the virtual reality world and/or when such primary sounds are absent), the ambient sound channels may enhance the realism and immersiveness of the virtual reality world as compared to ambient sound channels that do not take directionality into account and/or are location-confined.

Specifically, like the graphics and primary sound channels being presented to the user, ambient sound channels extracted in accordance with the methods and system described herein may account for directionality of what a user is experiencing in the virtual reality world with respect to a location of the user and/or a direction in which the user is oriented (e.g., a direction that the user is facing) within the virtual reality world. Thus, for instance, if an immersive virtual reality world is based on a real-world scene that is near a train track on which a train is passing, B-format surround sound ambient signals may allow the ambient train noise to be rendered as if coming from the direction of the train track, as opposed to coming from another direction or coming equally from all directions. This is true even as the user reorients himself or herself (e.g., looks around in different directions) in the immersive virtual reality world. It will be understood that multiple simultaneous users of a single virtual reality experience may all experience different ambient sound based on their particular viewing orientation within the virtual reality world.

Additionally, while a relatively small number of ambient audio channels may be used to provide ambient sound for a given scene (e.g., one universal channel may typically be presented, although more than one ambient channel may also be presented in certain examples), ambient sound extracted and presented in accordance with the disclosed methods and systems may not be confined to a single location (e.g., a location from which the multi-capsule microphone captures the ambient sound upon which the B-format signal is generated), but, rather, may diffusely represent ambient sound recorded at various locations around the scene. For example, if an electrical generator is humming in a corner of a scene that is too remote from the multi-capsule microphone to capture clearly, the methods and systems described herein may produce a location-diffused sound channel that incorporates elements of the electrical generator humming sound, as well as other ambient sound sources around the scene near and far from the multi-capsule microphone, in a diffuse mix that sounds realistic regardless of where a user may be located within the scene.

Various embodiments will now be described in more detail with reference to the figures. The disclosed systems and methods may provide one or more of the benefits mentioned above and/or various additional and/or alternative benefits that will be made apparent herein.

In order to extract location-diffused ambient sound from a real-world scene, ambient sound captured by microphones at different locations around a capture zone of a real-world scene may be combined in any suitable way. To illustrate, FIG. 1 shows a capture zone 102 of a real-world scene 104 that includes a plurality of microphones 106 (e.g., microphones 106-1 through 106-6) disposed at various locations around capture zone 102 to capture ambient sound generated by, for example, a plurality of ambient sound sources 108 (e.g., ambient sound sources 108-1 through 108-4).

Real-world scene 104, as well as other real-world scenes that will be described herein, may be associated with any real-world scenery, real-world location, real-world event (e.g., live event, etc.), or other subject existing in the real world (e.g., as opposed to existing only in a virtual world) and that may be captured by cameras and/or microphones and the like to be replicated in media content such as virtual reality media content. For example, as used herein, a "real-world scene" may include any indoor or outdoor real-world location such as the streets of a city, an interior of a building, a scenic landscape, or the like. In certain examples, real-world scenes may be associated with real-world places or events that exist or take place in the real-world, as opposed to existing or taking place only in a virtual world. For example, a real-world scene may include a sporting venue where a sporting event such as a basketball game is taking place, a concert venue where a concert is taking place, a theater where a play or pageant is taking place, an iconic location where a large-scale celebration is taking place (e.g., New Year's Eve on Times Square, Mardis Gras, etc.), a production set associated with a fictionalized scene where actors are performing to create media content such as a movie, television show, or virtual reality media program, or any other indoor or outdoor real-world place and/or event that may interest potential viewers.

As such, capture zone 102, as well as other capture zones described herein, may refer to a particular area within a real-world scene (e.g., real-world scene 104) at which capture devices (e.g., color video cameras, depth capture devices, etc.) and/or microphones (e.g., microphones 106) are disposed for capturing visual and audio data of the real-world scene. For example, if real-world scene 104 is associated with a basketball venue such as a professional basketball stadium where a professional basketball game is taking place, capture zone 102 may be the actual basketball court where the players are playing.

In the example of FIG. 1, each of microphones 106 may be a single-capsule omnidirectional microphone (i.e., a microphone configured to capture sound equally from all directions surrounding the microphone). For this reason, microphones 106 are represented in FIG. 1 by small symbols illustrating an omnidirectional polar pattern (i.e., a circle drawn on top of coordinate axes indicating that capture sensitivity is the same regardless of the directionality of where sound originates). In certain examples, each microphone 106 may be a single-capsule microphone, including only a single capsule for capturing a single (i.e., monophonic) audio signal, as opposed to multi-capsule microphones (e.g., stereo microphones, full-sphere multi-capsule microphones, etc.), which may include multiple capsules for capturing a plurality of distinct audio signals. Because microphones 106 are omnidirectional, each of the locations with respect to capture zone 102 at which microphones 106 are disposed may be within capture zone 102 of real-world scene 104 such that microphones 106 are integrated and/or intermingled with ambient sound sources 108.

Ambient sound sources 108 may include any sources of sound within real-world scene 104 (e.g., whether originating from within capture zone 102 or from the area surrounding capture zone 102) that add to the ambience of the scene but are not primary sounds (e.g., voices or the like that are meant to be understood by users viewing media content and which may be captured separately from the ambient sound). For instance, in the basketball game example, ambient sound sources 108 may include cheering of the crowd, coaches yelling indistinct instructions to players, the sound of footsteps of various players running back and forth across the floor, and so forth. In other types of real-world scenes, ambient sound sources 108 may include other types of ambient sound sources as may serve a particular implementation.

In some examples, it may not be practical or possible to place microphones (e.g., single-capsule microphones) directly within a capture zone of a real-world scene due to interference by events taking place within the capture zone. For example, if gameplay (e.g., of a basketball game) is occurring within a particular capture zone of a real-world scene, single-capsule microphones may need to be placed out of bounds around where gameplay is taking place. It will be understood that various other types of real-world scenes besides sporting events may similarly include capture zones in which it is not practical or possible to place microphones for similar reasons.

Figure 2:
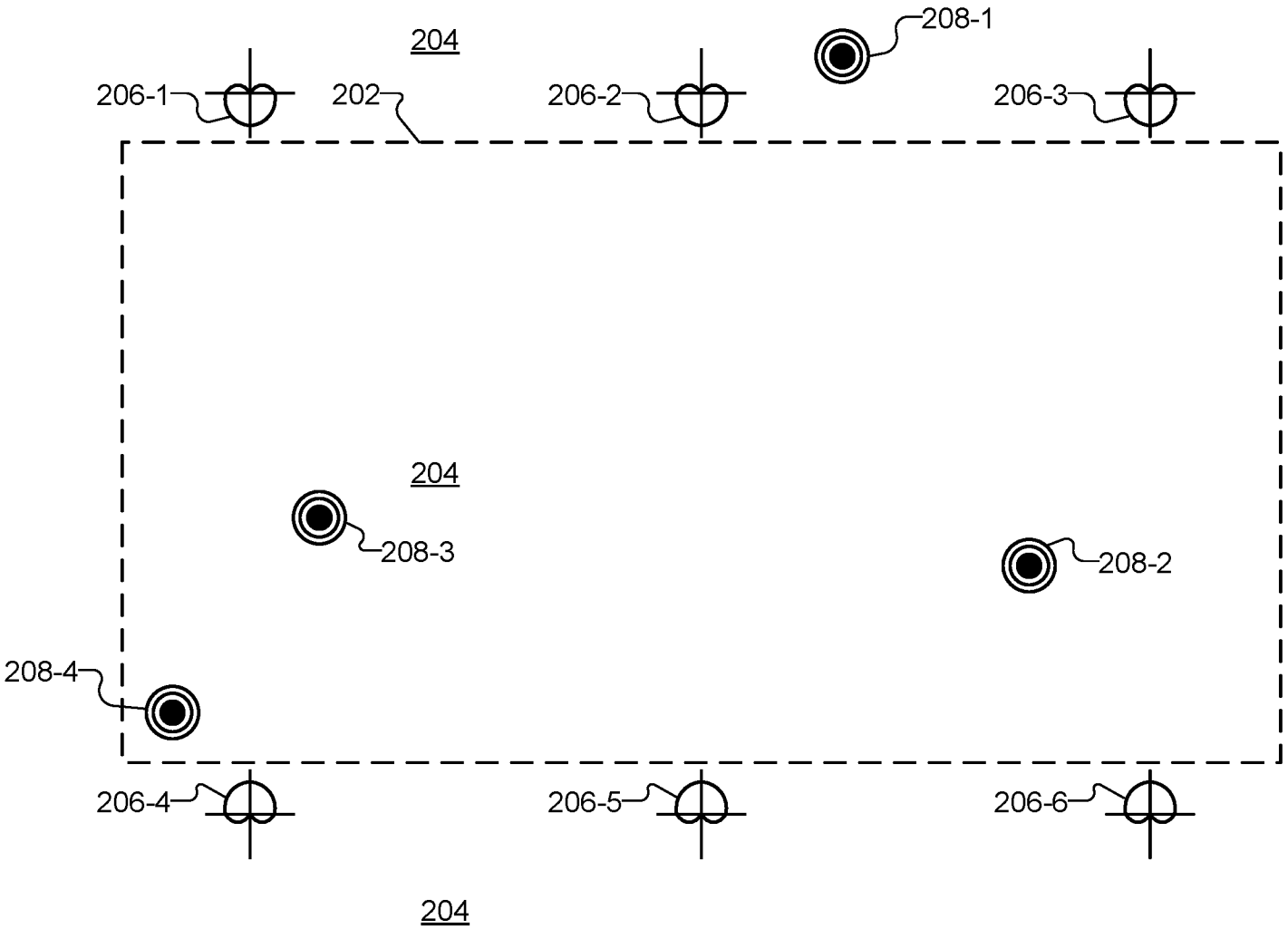

To illustrate, FIG. 2 shows another capture zone 202 within a real-world scene 204 that may be similar to capture zone 102 within real-world scene 104. Because it may not be practical or possible to place single-capsule microphones directly within capture zone 202 to capture ambient sound, a plurality of microphones 206 (e.g., microphones 206-1 through 206-6) may be placed outside of capture zone 202 (e.g., so as to surround capture zone 202 on one or more sides). Microphones 206 may be directional microphones (i.e., microphones configured to capture sound better from certain directions than others) that are oriented toward locations within capture zone 202 to capture ambient sound originating from various ambient sound sources 208 (i.e., ambient sound sources 208-1 through 208-4, which may be similar to ambient sound sources 108 described above). For this reason, microphones 206 are represented in FIG. 2 by small symbols illustrating directional polar patterns (i.e., a cardioid pattern drawn on top of coordinate axes indicating that capture sensitivity is greater in a direction facing capture zone 202 than in other directions). While cardioid polar patterns are illustrated in FIG. 2, it will be understood that any suitable directional polar patterns (e.g., cardioid, supercardioid, hypercardioid, subcardioid, figure-8, etc.) may be used as may serve a particular implementation. In certain examples, as with microphones 106, each microphone 206 may be a single-capsule microphone including only a single capsule for capturing a single (i.e., monophonic) audio signal. In other examples, one or more of microphones 206 may include multiple capsules used to capture directional signals (e.g., using beamforming techniques or the like). Because microphones 206 are directional and aiming inward toward capture zone 202, microphones 206 may suitably capture ambient sound for inside capture zone 202 even while remaining at locations with respect to capture zone 202 that are outside capture zone 202 of real-world scene 204 and are, as such, less integrated and/or intermingled with ambient sound sources 208 than were microphones 106 illustrated above.

While not explicitly illustrated in FIG. 1 or 2, it will be understood that in certain examples, one or more microphones (e.g., single-capsule microphones) may be disposed inside a capture zone while one or more other microphones may be disposed outside the capture zone. Additionally, it will be understood that, as used herein, a location at which a particular microphone is "disposed" may refer both to a location (e.g., a location with respect to a capture zone of a real-world scene) and an orientation (e.g., especially if the microphone is a directional microphone) at which the microphone is directed or pointing.

Figure 3:
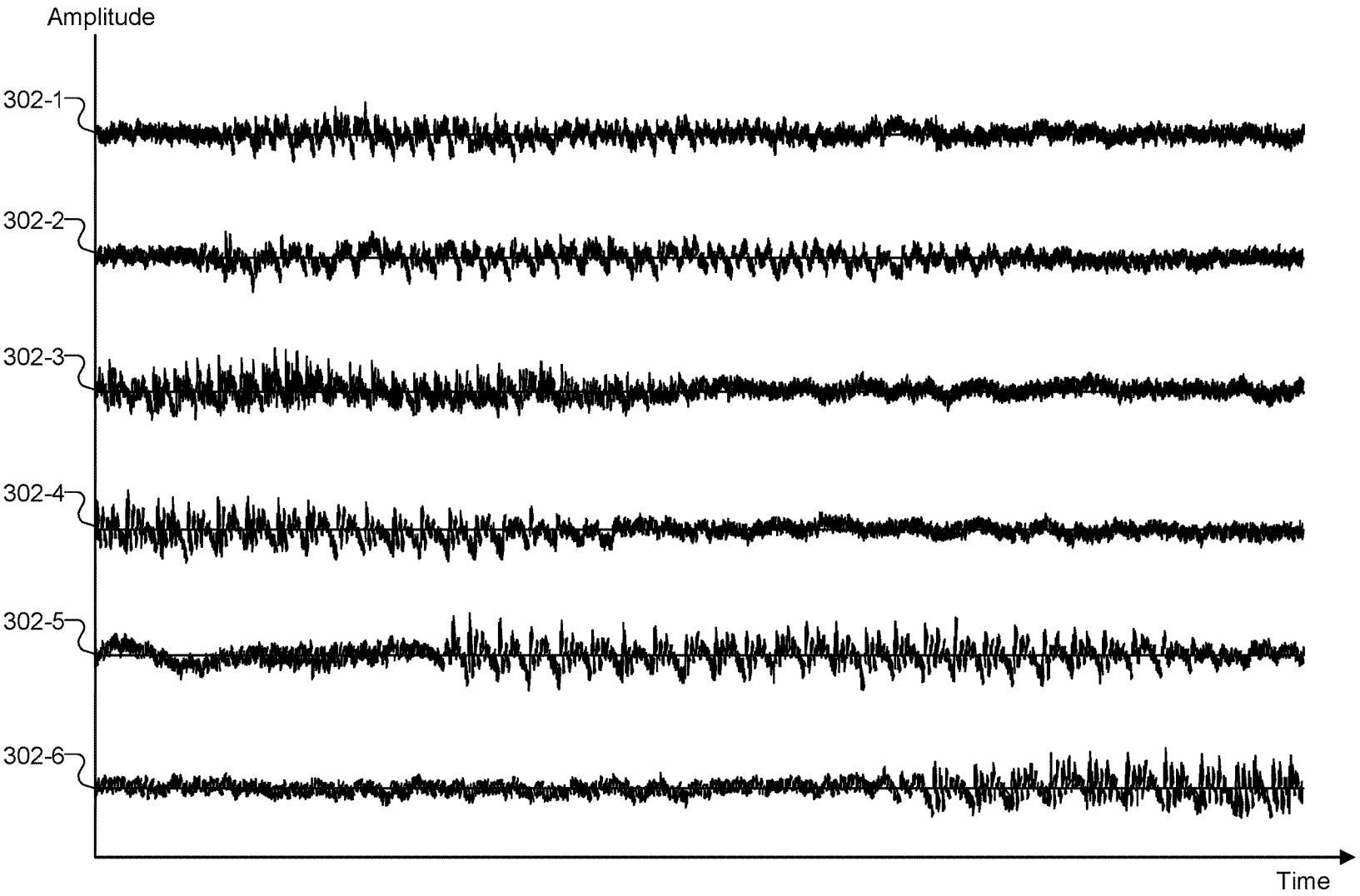
FIG. 3 illustrates an exemplary set of audio signals representative of ambient sound captured by various microphones disposed at different locations with respect to a capture zone of a real-world scene according to principles described herein.

FIG. 3 illustrates an exemplary set of audio signals 302 (e.g., audio signals 302-1 through 302-6) that are representative of ambient sound captured by various microphones disposed at locations with respect to a capture zone of a real-world scene. For example, the set of audio signals 302 may be captured by microphones 106 to be representative of ambient sound originating from ambient sound sources 108 in capture zone 102 of real-world scene 104, or may be captured by microphones 206 to be representative of ambient sound originating from ambient sound sources 208 in capture zone 202 of real-world scene 204. As shown, audio signals 302 are each captured and represented as an amplitude (e.g., a voltage, a digital value, etc.) that changes with respect to time. Accordingly, as audio signals 302 are represented in FIG. 3, audio signals 302 may be referred to herein as being in a time domain. Additionally, while audio signals 302 may be captured and represented in FIG. 3 as analog signals, it will be understood that each of audio signals 302 may be digitized prior to being processed as described below.

Because each of audio signals 302 may be captured by a separate microphone (e.g., a separate microphone 106 or 206) disposed at a different location within a capture zone (e.g., capture zone 102 or 202), audio signals 302 may each be referred to as location-confined audio signals. As used herein, "location-confined" signals are composed entirely of information associated with (e.g., captured from, representative of, etc.) a single location. For example, if audio signal 302-1 is captured by microphone 106-1, audio signal 302-1 may be composed entirely of ambient sound information captured from the location of microphone 106-1 within capture zone 102.

In contrast, as used herein, "location-diffused" signals are composed of information associated with a plurality of locations. For example, in order to generate a universal ambient sound channel for capture zone 102 or 202 that represents ambient sound captured from each of the microphones 106 or 206 included in these capture zones (e.g., and thereby represents ambient sound originating from all of the ambient sound sources 108 or 208), it may be desirable to combine or mix the set of audio signals 302 into a single audio signal that represents ambient sound for the entire scene.

This combining or mixing together of audio signals 302-1 to generate a location-diffused audio signal may be performed in any suitable way. For example, audio signals may be added, filtered, and/or otherwise mixed together in any suitable manner. In some examples, location-confined audio signals 302-1 may be combined into a location-diffused audio signal by way of an averaging technique such as a median filtering technique, a mean filtering technique, or another suitable averaging technique.

Figure 4:
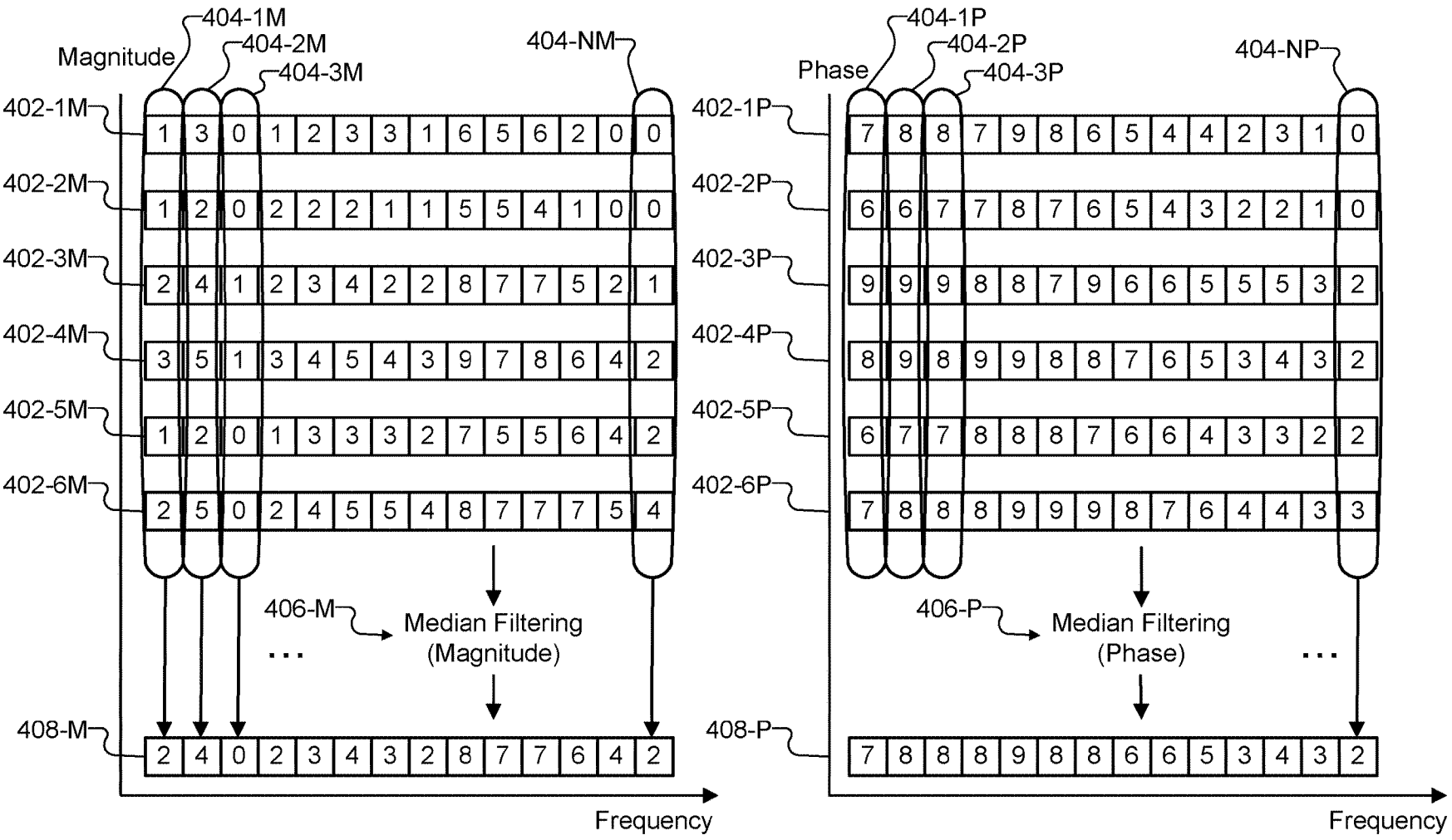
FIGS. 4-5 illustrate an exemplary median filtering technique for combining the set of audio signals of FIG. 3 into a single audio signal representative of location-diffused ambient sound in the capture zone according to principles described herein.
Figure 5:
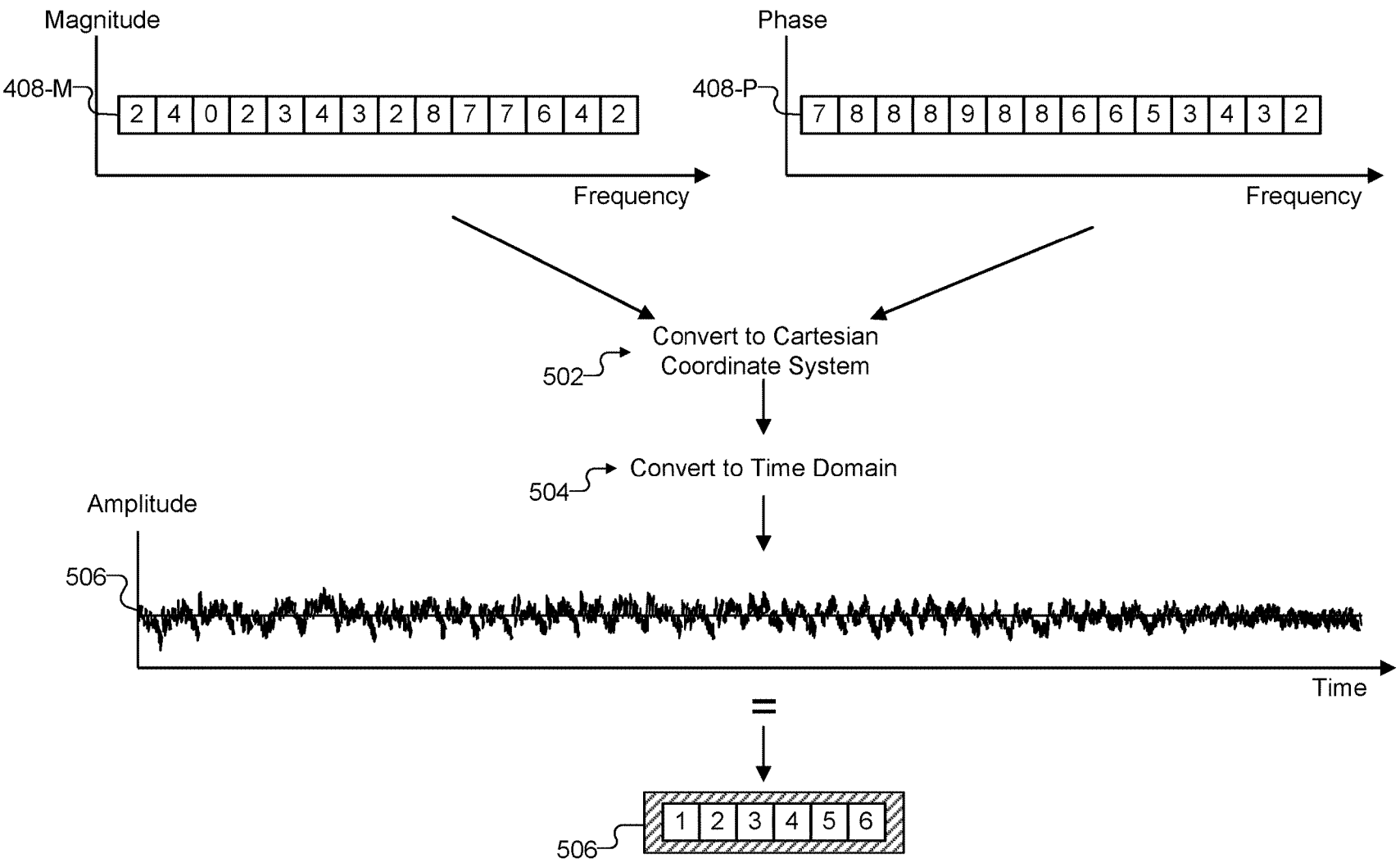

To illustrate, FIGS. 4 and 5 show an exemplary median filtering technique for combining the set of audio signals 302 into a single audio signal representative of location-diffused ambient sound in the capture zone in which audio signals 302 were captured (e.g., capture zone 102, 202, or the like). Specifically, as shown in FIG. 4, each of audio signals 302 may be converted from time-domain audio signals 302 into frequency domain audio signals 402 (i.e., audio signals 402-1M through 402-6M and 402-1P through 402-6P). As shown, each audio signal 402 may consist of both magnitude components designated with an 'M', and phase components designated with a 'P'. Thus, for example, a magnitude component 402-1M and a phase component 402-1P illustrated in FIG. 4 may together constitute a frequency domain audio signal referred to as audio signal 402-1, a magnitude component 402-2M and a phase component 402-2P illustrated in FIG. 4 may together constitute a frequency domain audio signal referred to as audio signal 402-2, and so forth.

Frequency domain audio signals 402 may be generated based on time domain audio signals 302 (e.g., digital versions of time domain audio signals 302) using a Fast Fourier Transform ("FFT") technique or another suitable technique used for converting (i.e., transforming) time domain audio signals into frequency domain audio signals. As such, time domain audio signal 302-1 may correspond to frequency domain audio signal 402-1, time domain audio signal 302-2 may correspond to frequency domain audio signal 402-2, and so forth.

Whereas time domain signals may represent the amplitude of a sound with respect to time, frequency domain signals may represent the magnitude and phase of each constituent frequency that makes up the signal with respect to frequency. Thus, along the respective horizontal axes in the phase and magnitude graphs of FIG. 4, each box may represent a particular frequency band in a plurality of frequency bands associated with converting the set of audio signals 302 into the frequency domain (e.g., by way of the FFT technique). In other words, the frequency range perceptible to humans (e.g., approximately 20 Hz to approximately 20 kHz) may be broken up into a plurality of frequency bands that may be associated with constituent components of any given sound heard by humans. In the frequency domain, values (e.g., digital values) representative of both the magnitude of each component of each frequency band and the phase of each component of each frequency band may be determined and included within a frequency domain audio signal such as frequency domain audio signals 402.

For the sake of clarity and simplicity of illustration, each audio signal 402 in FIG. 4 shows single digit values (i.e., 0-9) representative of both a magnitude value (in the magnitude graph on the left) and a phase value (in the phase graph on the right) for each of the plurality of frequency bands extending along the respective horizontal frequency axes. It will be understood that these single-digit values are for illustration purposes only and may not resemble actual magnitude and/or phase values of an actual frequency domain signal with respect to any standard units of magnitude (e.g., gain) or phase (e.g., degrees, radians, etc.). Thus, for example, considering audio signal 402-1, at a first (i.e., lowest) frequency band, FIG. 4 illustrates that audio signal 402-1 has a magnitude value of '1' and a phase value of '7', followed by a magnitude value of '3' and a phase value of '8' for the next frequency band, a magnitude value of '0' and a phase value of '8' for the next frequency band, and so forth up to a magnitude value of '0' and phase value of '0' for the Nth frequency band (i.e., the highest frequency band).

By averaging magnitude and phase values from audio signals 402 for each frequency band while audio signals 402 are in the frequency domain, a location-diffused frequency domain signal may be generated. For example, the magnitude values for each frequency band are indicated by different groupings 404-M (e.g., groupings 404-1M through 404-NM). Specifically, magnitude values for the lowest frequency band are indicated by grouping 404-1M, magnitude values for the second lowest frequency band are indicated by grouping 404-2M, and so forth up to the magnitude values for the highest frequency band, which are indicated by grouping 404-NM. Similarly, the phase values for each frequency band are indicated by different groupings 404-P (e.g., groupings 404-1P through 404-NP). Specifically, phase values for the lowest frequency band are indicated by grouping 404-1P, phase values for the second lowest frequency band are indicated by grouping 404-2P, and so forth up to the phase values for the highest frequency band, which are indicated by grouping 404-NP.

As shown, median filtering 406 (i.e., median filtering with respect to magnitude 406-M and median filtering with respect to phase 406-P) may be performed on each grouping 404 to generate a median frequency domain audio signal 408 that, like each of frequency domain audio signals 402, is composed of both magnitude values 408-M and phase values 408-P. As shown, median filtering 406 may be performed by designating a median value from all the values in a particular grouping 404 to be the value associated with the frequency band of the particular grouping 404 in median frequency domain audio signal 408. For example, the values in grouping 404-1M include, from audio signal 402-1M through 402-6M respectively, '1', '1', '2', '3,' '1', and '2'. To take the median of these values, the values may be ordered from least to greatest: '1', '1', '1', '2', '2', '3'. The median value is the middle value if there are an odd number of values (e.g., if there had been an odd number of audio signals captured by an odd number of microphones), or, if there are an even number of values (such as the six values shown in this example), the median value may be derived from the middle two values (i.e., '1' and '2' in this example).

The median value may be determined from the middle two values in any suitable way. For example, a mean of the two values may be calculated to be the median for the six values (i.e., a value of '1.5' is the mean of values '1' and '2' in this example). In other examples, the higher of the two values (i.e., '2' in this example) may always be selected, the lower of the two values (i.e., '1' in this example) may always be selected, or a random one of the two values (i.e., either '1' or '2') may be selected to be the median value. As shown in FIG. 4, in examples where the two middle values are different such as in the case of grouping 404-1M, the higher of the two middle values (i.e., '2' in the example of grouping 404-1M) is designated as the median filtered value of the grouping for that particular frequency band of median frequency domain audio signal 408.

As shown, all the groupings 404-M of magnitude values and 404-P of phase values have been median filtered in accordance with the technique described above to derive values 408-M and 408-P, respectively, of median frequency domain audio signal 408. Specifically, the averaging of the magnitude and phase values in each grouping 404 includes performing median filtering 406-M of magnitude values of audio signals 402-1M through 402-6M, as well as performing, independently from the median filtering of the magnitude values, median filtering 406-P of phase values of audio signals 402-1P through 402-6P. Median filtering 406-M of the magnitude values and 406-P of the phase values are both performed for each frequency band in a plurality of frequency bands associated with the converting of time domain audio signals 302 into frequency domain audio signals 402 (e.g., associated with the FFT operation), as shown.

Once median filtering 406 has been performed, median frequency domain audio signal 408 may include information from each of audio signals 402 which, in turn, include information captured at different locations around a capture zone, as described above with respect to time domain audio signals 302. Accordingly, audio signal 408 may be used as a basis for generating a location-diffused ambient audio signal representative of ambient sound captured throughout the capture zone of the real-world scene. However, as opposed to signals derived using certain other methods of combining audio signals (e.g., conventional mixing techniques) location-diffused audio signals derived from median frequency domain audio signal 408 may be based on actual magnitude and phase values that have been sampled in various locations around the capture zone, rather than artificially combined mixtures of such real samples. Accordingly, a location-diffused audio signal derived from median frequency domain audio signal 408 may not only represent ambient audio recorded from multiple locations, but also may sound more genuine or "true-to-life" (i.e., less synthetic or "fake") than location-diffused audio signals generated based on other types of averaging techniques (e.g., mean filtering techniques) or mixing techniques.

On the other hand, other types of averaging techniques and/or mixing techniques may also be associated with certain advantages such as relative ease of implementation and the like. As a result, it will be understood that methods and systems for extracting location-diffused ambient sound from a real-world scene may employ median filtering and/or any other averaging and/or mixing techniques as may serve a particular implementation.

To generate a location-diffused audio signal representative of ambient sound captured throughout the capture zone of the real-world scene, FIG. 5 illustrates certain additional operations that may be performed to convert audio signal 408 into a location-diffused audio signal in the time domain. Specifically, as shown, a coordinate system conversion operation 502 may be performed to convert the median magnitude values 408-M and median phase values 408-P from a polar coordinate system to a cartesian coordinate system. Thereafter, audio signal 408 may undergo a conversion from the frequency domain to the time domain in a time domain transformation operation 504. For example, time domain transformation operation 504 may be implemented using an inverse FFT technique or another suitable technique for converting a frequency domain signal into the time domain.

As a result of operations 502 and 504, a location-diffused time domain audio signal 506 may be generated that represents the median-filtered values of the entire set of audio signals 302 captured by microphones distributed at locations around the capture zone. As shown in FIG. 5, location-diffused time domain signal 506 may be illustrated as a soundwave graph with respect to amplitude and time similar to the soundwave graphs with which audio signals 302 were illustrated in FIG. 3. Additionally, below the soundwave graph, FIG. 5 shows an alternative representation of location-diffused time domain signal 506 that indicates which signals and/or locations have been incorporated within the location-diffused audio signal. Specifically, as shown, because signals 302-1 through 302-6 (which may be captured at six different locations around a capture zone) are all represented within location-diffused time domain audio signal 506 (i.e., having all been included in median filtering 406), the symbol representation of location-diffused time domain audio signal 506 in FIG. 5 shows a shaded box including boxes 1 through 6.

With various methods for combining location-confined signals to form location-diffused signals (e.g., including averaging techniques such as median filtering techniques) having been described above, methods and systems for extracting location-diffused ambient sound from a real-world scene will now be described. In particular, while median filtering and the other methods for forming location-diffused signals described above may be employed in various applications in which directionality may be of less concern (e.g., including applications such as telephone conference calling, conventional television and movie media content, etc.), the methods and systems described below will illustrate how median filtering and/or other methods for forming location-diffused signals described above may be employed in applications in which it may be more important to capture ambient sound with respect to directionality (e.g., including applications such as generating virtual reality media content).

Figure 6:
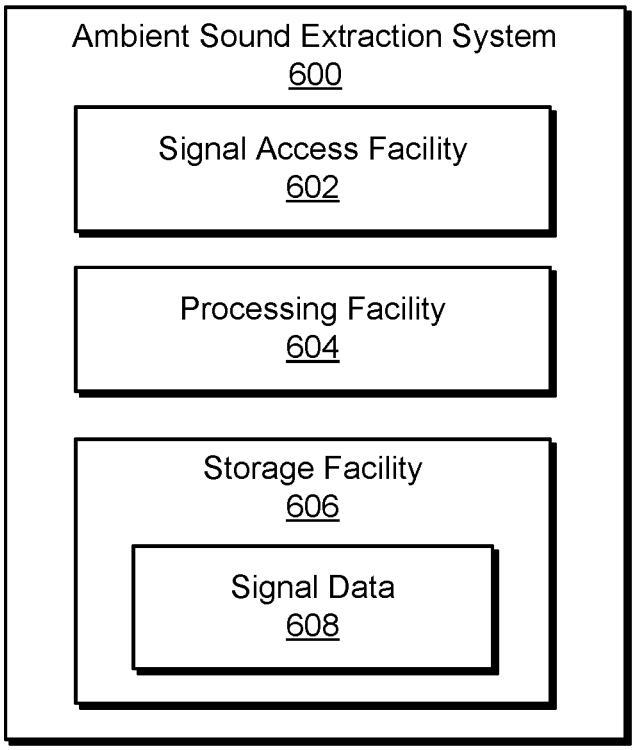
FIG. 6 illustrates an exemplary ambient sound extraction system for extracting location-diffused ambient sound from a real-world scene according to principles described herein.

To this end, FIG. 6 illustrates an exemplary ambient sound extraction system 600 ("system 600") for extracting location-diffused ambient sound from a real-world scene. As shown, system 600 may include, without limitation, a signal capture facility 602, a processing facility 604, and a storage facility 606 selectively and communicatively coupled to one another. It will be recognized that although facilities 602 through 606 are shown to be separate facilities in FIG. 6, facilities 602 through 606 may be combined into fewer facilities, such as into a single facility, or divided into more facilities as may serve a particular implementation. Each of facilities 602 through 606 may be distributed between multiple devices and/or multiple locations as may serve a particular implementation. Additionally, one or more of facilities 602 through 606 may be omitted from system 600 in certain implementations, while additional facilities may be included within system 600 in the same or other implementations. Each of facilities 602 through 606 will now be described in more detail.

Signal access facility 602 may include any hardware and/or software (e.g., including microphones, audio interfaces, network interfaces, computing devices, software running on or implementing any of these devices or interfaces, etc.) that may be configured to capture, receive, download, and/or otherwise access audio signals for processing by processing facility 604. For example, signal access facility 602 may access, from a multi-capsule microphone (e.g., a full-sphere multi-capsule microphone) disposed at a first location with respect to a capture zone of a real-world scene, a location-confined A-format signal that includes a first set of audio signals captured by different capsules of the multi-capsule microphone. Signal access facility 602 may also access, from a plurality of microphones disposed at a plurality of other locations with respect to the capture zone that are distinct from the first location, a second set of audio signals captured by the plurality of microphones.

Signal access facility 602 may access any of the audio signals described herein and/or other suitable audio signals in any manner as may serve a particular implementation. For instance, in certain implementations, signal access facility 602 may include one or more microphones (e.g., including the multi-capsule microphone, one or more of the plurality of microphones, etc.) such that accessing the respective audio signals from these microphones may be performed by using the integrated microphones to directly capture the signals. In the same or other implementations, some or all of the audio signals accessed by signal access facility 602 may be captured by microphones that are external to system 600 under the direction of signal access facility 602 or of another system. For instance, signal access facility may receive audio signals directly from microphones external to, but communicatively coupled with, system 600, and/or from another system or storage facility that is directly connected to the microphones and provides the audio signals to system 600 in real time or after the audio signals have been recorded and stored. Regardless of how system 600 is configured with respect to the microphones and/or any other external equipment, systems, or storage used in the audio signal capture process, as used herein, system 600 may be said to access an audio signal from a particular microphone if system 600 has received the audio signal and the particular microphone captured the audio signal.

Processing facility 604 may include one or more physical computing devices (e.g., the same hardware and/or software components included within signal access facility 602 and/or components separate from those of signal access facility 602) that perform various operations associated with generating a location-diffused A-format signal that includes a third set of audio signals (e.g., a third set of audio signals based on the first and second sets of audio signals) and/or generating a location-diffused B-format signal representative of ambient sound in the capture zone based on the location-diffused A-format signal. For example, as will be described in more detail below, processing facility 604 may combine each of the audio signals in the first set of audio signals (i.e., the audio signals included in the location-confined A-format signal) with one or more of (e.g., all of) the signals in the second set of audio signals using median filtering or other combining techniques described herein to thereby generate the third set of audio signals (i.e., the audio signals included in the location-diffused A-format signal).

Once the location-diffused A-format signal has been generated, processing facility 604 may convert the location-diffused A-format signal into a location-diffused B-format signal that may be provided for use in various applications as a directional, location-diffused audio signal. In some examples, the location-diffused A-format signal may be generated in real time (e.g., using an overlap-add technique or the like in the process of converting signals from the time domain to the frequency domain and vice versa). Concurrently with the generation of the location-diffused A-format signal, the location-diffused B-format signal may also be generated in real-time. The location-diffused B-format signal may be provided to a virtual reality provider system or component thereof for use in generating virtual reality media content to be experienced by one or more virtual reality users.

Storage facility 606 may include signal data 608 and/or any other data received, generated, managed, maintained, used, and/or transmitted by facilities 602 and 604. Signal data 608 may include data associated with audio signals such as location-diffused A-format signals, location-confined A-format signals, location-diffused B-format signals, audio signals captured by single-capsule microphones, and/or any other suitable signals or data used to implement the methods and systems described herein.

In one specific implementation of system 600, signal access facility 602 may include a full-sphere multi-capsule microphone disposed at a first location with respect to a capture zone of a real-world scene and a plurality of single-capsule microphones disposed at a plurality of other locations with respect to the capture zone that are distinct from the first location. Signal access facility 602 may further include at least one physical computing device that captures (e.g., by way of different capsules of the full-sphere multi-capsule microphone) a first set of audio signals included within a location-confined A-format signal, and captures (e.g., by way of the plurality of single-capsule microphones) a second set of audio signals.

Processing facility 604, using the same or other computing resources as signal access facility 602, may convert the first and second sets of audio signals from a time domain into a frequency domain and may perform (e.g., while the first and second sets of audio signals are in the frequency domain) a median filtering of magnitude values and phase values of a plurality of combinations of audio signals each including a respective one of the audio signals in the first set of audio signals and all of the audio signals in the second set of audio signals. Based on the median filtering of the magnitude values and the phase values of each combination of audio signals in the plurality of combinations, processing facility 604 may generate a different frequency domain audio signal included within a set of frequency domain audio signals, and may convert the values in each of the set of frequency domain audio signal from a polar coordinate system to a cartesian coordinate system. Processing facility 604 may then convert the set of frequency domain audio signals from the frequency domain into the time domain to form a third set of audio signals included in a location-diffused A-format signal. Finally, processing facility 604 may generate (e.g., based on the location-diffused A-format signal) a location-diffused B-format signal representative of ambient sound in the capture zone.

Some of the concepts in this exemplary implementation such as converting signals into the frequency domain, performing median filtering on frequency domain versions of the signals, converting the median filtered signals from polar coordinates to cartesian coordinates, and converting the signals back into the time domain have been described above. Other concepts more particular to full-sphere multi-capsule microphone signals (e.g., A-format and B-format signals, etc.) will be described in more detail now.

Figure 7:
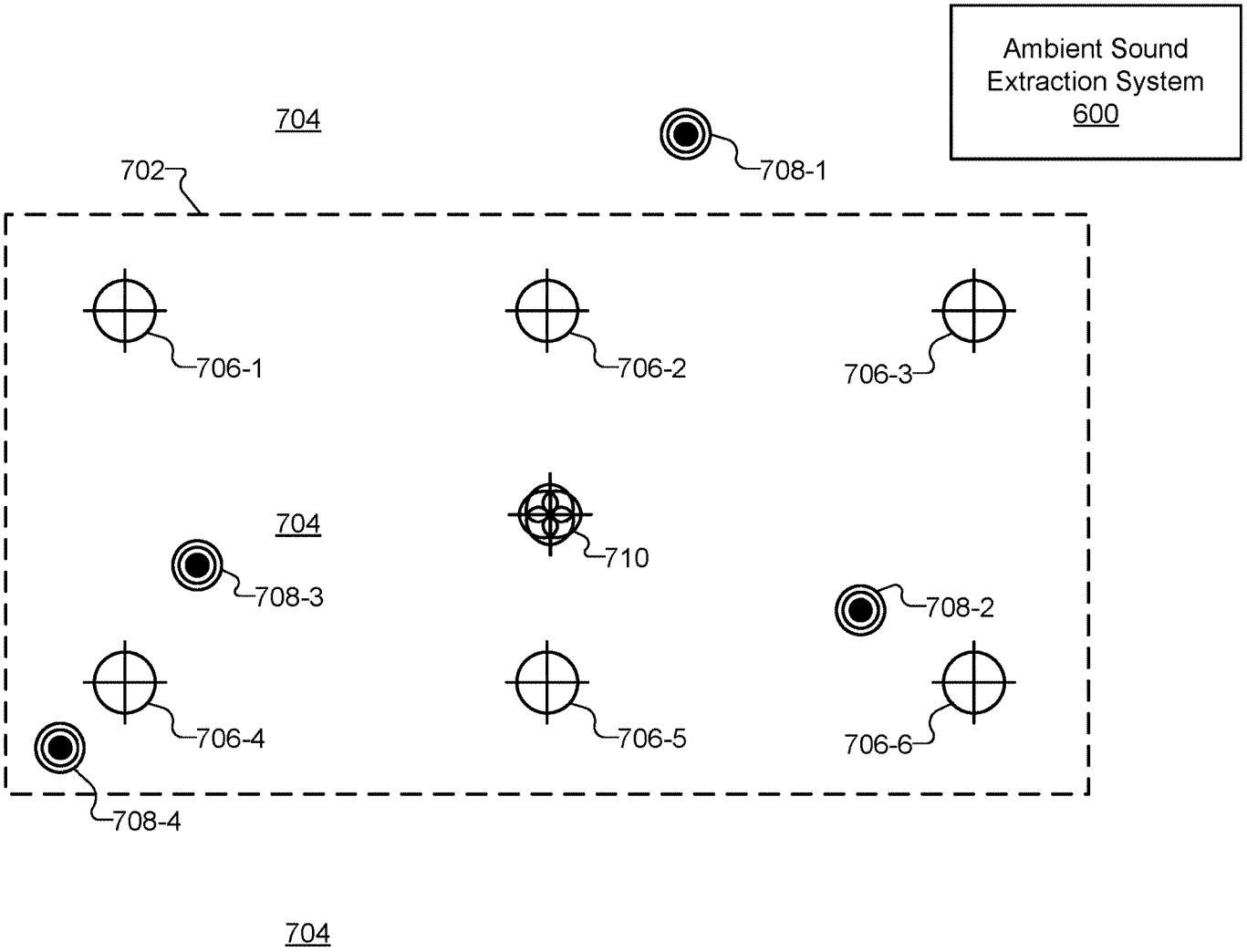
FIG. 7 illustrates another exemplary capture zone of another real-world scene from which ambient sound may be extracted by the ambient sound extraction system of FIG. 6 according to principles described herein.

FIG. 7 illustrates another exemplary capture zone 702 of another real-world scene 704 that may be similar to capture zones 102 and 202 of real-world scenes 104 and 204, described above. Ambient sound may be extracted from capture zone 702 by system 600 in accordance with principles described herein. In particular, while the examples set forth in FIGS. 1 and 2 related only to methods for combining location-confined audio signals into a singular location-diffused audio signal, the example set forth with respect to FIG. 7 will relate to combining location-confined audio signals into a plurality of location-diffused audio signals that maintains a full-sphere surround sound (e.g., a 3D directionality) for use in applications such as virtual reality media content or the like.

As shown in FIG. 7, a plurality of omnidirectional microphones 706 (e.g., omnidirectional microphones 706-1 through 706-6) may be located at various locations around capture zone 702 so as to be integrated with ambient sound sources 708 (e.g., ambient sound sources 708-1 through 708-4) in a similar way as microphones 106 were positioned in FIG. 1. It will be understood that, in addition or as an alternative to omnidirectional microphones 706 being disposed at the locations shown, different or additional microphones such as directional microphones 206 may be disposed in different locations with respect to capture zone 702 (e.g., locations inside or outside of capture zone 702) in any of the ways and/or for any of the reasons described herein.

System 600 is illustrated in real-world scene 704 outside of capture zone 702, although it will be understood that various components of system 600 may be disposed in any suitable locations inside or outside of a capture zone as may serve a particular implementation. As described above, any of the microphones shown in FIG. 7 may be included within (e.g., integrated as a part of) system 600 or may be separate from but communicatively coupled to system 600 by wired, wireless, networked, and/or any other suitable communication means.

Additionally, and in contrast with the configurations of FIGS. 1 and 2, FIG. 7 illustrates a multi-capsule microphone 710 disposed at a location within capture zone 702. As will be described and illustrated below, multi-capsule microphone 710 may be implemented as a full-sphere multi-capsule microphone, and may allow system 600 to perform one or more of the audio signal combination operations described above (e.g., median filtering, etc.) in such a way that a B-format signal may be generated that is representative of location-diffused ambient sound across capture zone 702 (i.e., at all of the locations of single-capsule microphones 706).

Full-sphere multi-capsule microphone 710 may be implemented in any way as may serve a particular implementation. For example, in certain implementations, full-sphere multi-capsule microphone 710 may include four directional capsules in a tetrahedral arrangement associated with a first-order Ambisonic microphone (e.g., a first-order SOUNDFIELD microphone). To illustrate, FIG. 8A shows a structural diagram illustrating exemplary directional capture patterns of full-sphere multi-capsule microphone 710. Specifically, FIG. 8A shows that full-sphere multi-capsule microphone 710 includes four directional capsules 802 (i.e., capsules 802-A through 802-D) in a tetrahedral arrangement. Next to each capsule 802, a small polar pattern 804 (i.e., polar patterns 804-A through 804-D, respectively) is shown to illustrate the directionality with which capsules 802 each capture incoming sound. Additionally, a coordinate system 806 associated with full-sphere multi-capsule microphone 710 is also shown. It will be understood that, in some examples, each capsule 802 may be centered on a side of a tetrahedron shape, rather than disposed at a corner of the tetrahedron as shown in FIG. 8A.

As shown in FIG. 8A, each polar pattern 804 of each capsule 802 is directed or pointed so that the capsule 802 captures more sound in a direction radially outward from a center of the tetrahedral structure of full-sphere multi-capsule microphone 710 than in any other direction. For example, as shown, each of polar patterns 804 may be cardioid polar patterns such that capsules 802 effectively capture sounds originating in the direction the respective polar patterns are pointed while effectively ignoring sounds originating in other directions. Because capsules 802 point away from the center of the tetrahedron, no more than one of capsules 802 may point directly along a coordinate axis (e.g., the x-axis, y-axis, or z-axis) of coordinate system 806 while the other capsules 802 point along other vectors that do not directly align with the coordinate axes. As such, while audio signals captured by each capsule 802 may collectively contain sufficient information to implement a 3D surround sound signal, it may be convenient or necessary to first convert the signal captured by full-sphere multi-capsule microphone 710 (i.e., the audio signals captured by each of capsules 802) to a format that aligns with a 3D cartesian coordinate system such as coordinate system 806.

Figure 8B:
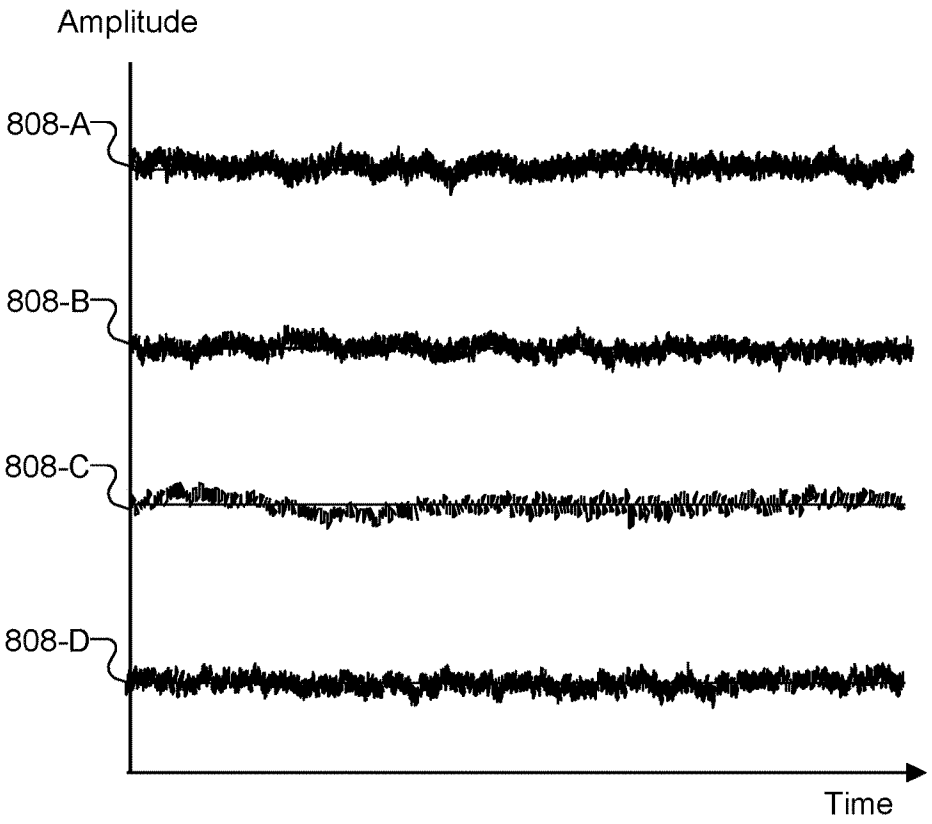
FIG. 8B illustrates a set of audio signals captured by different capsules of the multi-capsule microphone described in FIG. 8A and that collectively compose an A-format signal according to principles described herein.
Figure 8A:
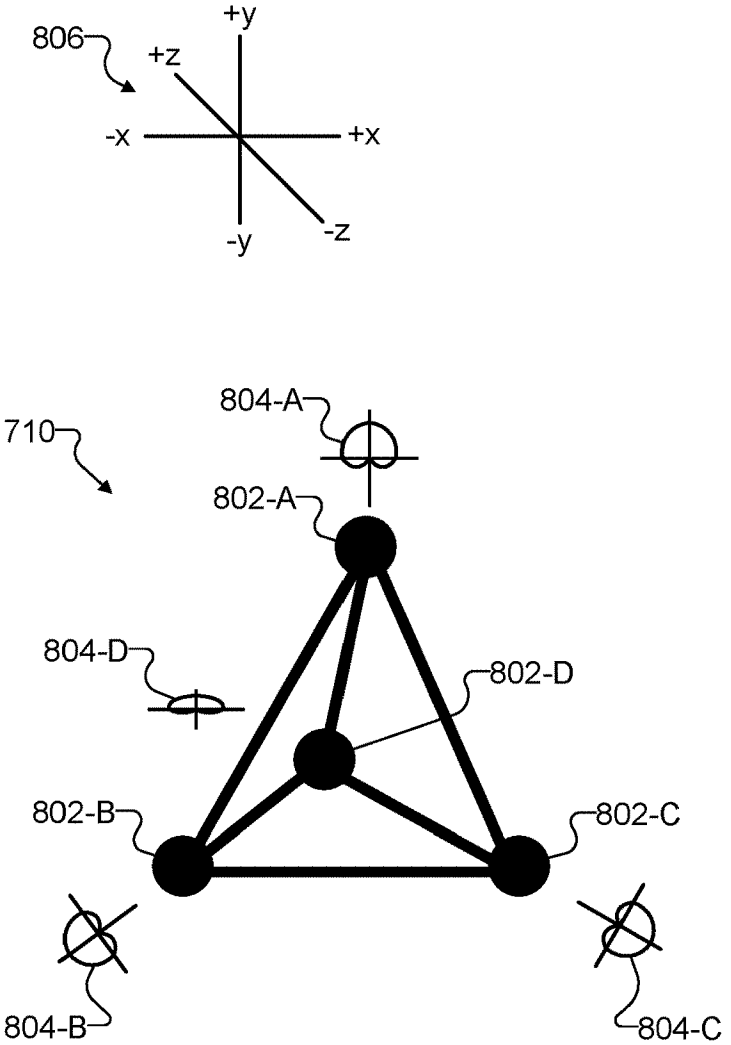
FIG. 8A illustrates exemplary directional capture patterns of an exemplary multi-capsule microphone according to principles described herein.

FIG. 8B illustrates a set of audio signals 808 (e.g., audio signals 808-A through 808-D) captured by different capsules 802 (e.g., captured by capsules 802-A through 802-D, respectively) of full-sphere multi-capsule microphone 710. Collectively, this set of four audio signals 808 generated by the four directional capsules 802 may compose what is known as an "A-format" signal. In particular, since all of capsules 802 are included within full-sphere multi-capsule microphone 710, which is confined to a single location within capture zone 702, and since capsules 802 are configured to capture ambient sound, the set of audio signals 808 may be referred to herein as a "location-confined A-format signal."

As mentioned above, an A-format signal may include sufficient information to implement 3D surround sound, but it may be desirable to convert the A-format signal from a format that may be specific to a particular microphone configuration to a more universal format that facilitates the decoding of the full-sphere 3D sound into renderable audio signals to be played back by specific speakers (e.g., a renderable stereo signal, a renderable surround sound signal such as a 5.1 surround sound signal, etc.). This may be accomplished by converting the A-format signal to a B-format signal. In some examples such as a first order Ambisonic implementation described below, converting the A-format signal to a B-format signal may further facilitate rendering of the audio by aligning the audio signals to a 3D cartesian coordinate system such as coordinate system 806.

Figure 9B:
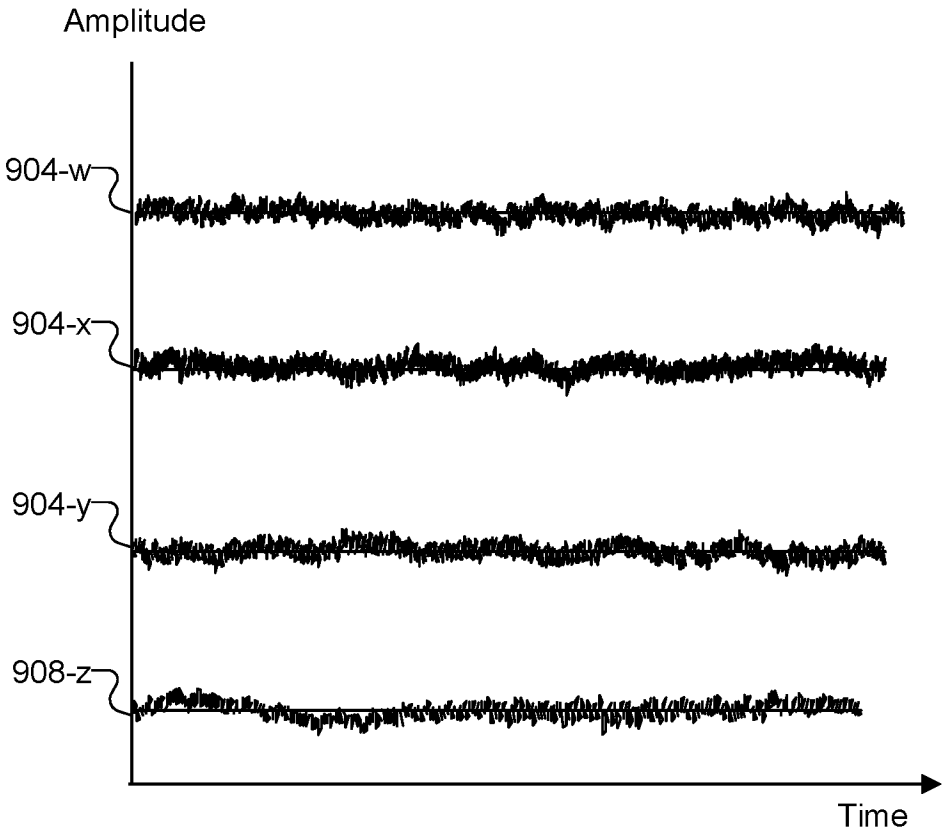
FIG. 9B illustrates a set of audio signals derived from the set of audio signals illustrated in FIG. 8B and that collectively compose a B-format signal according to principles described herein.
Figure 9A:
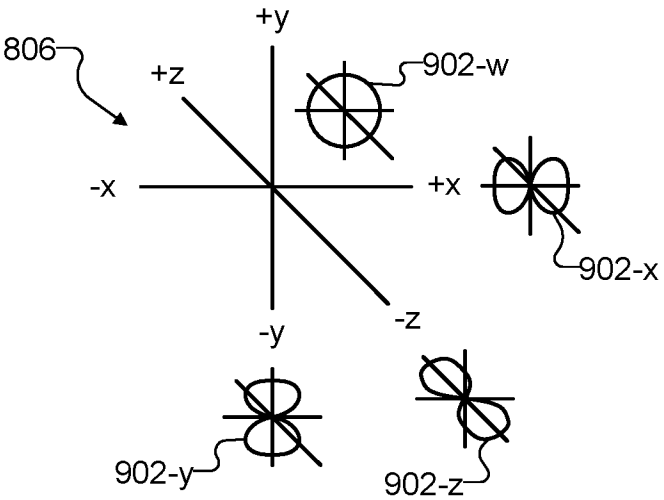
FIG. 9A illustrates additional directional capture patterns associated with the multi-capsule microphone described in FIG. 8A according to principles described herein.
Figure 9A:
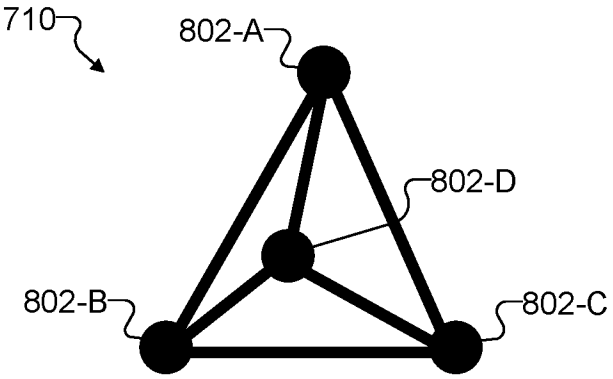

To illustrate, FIG. 9A shows additional directional capture patterns associated with full-sphere multi-capsule microphone 710 along with coordinate system 806, similar to FIG. 8A. In particular, in place of polar patterns 804 that are directly associated with directional audio signals captured by each capsule 802, FIG. 9A illustrates a plurality of polar patterns 902 (i.e., polar patterns 902-*w*, 902-*x*, 902-*y*, and 902-*z*) that are associated with the coordinate axes of coordinate system 806. Specifically, polar pattern 902-*w* is a spherical polar pattern that describes an omnidirectional signal representative of overall sound pressure captured from all directions, polar pattern 902-*x* is a figure-8 polar pattern that describes a directional audio signal representative of sound originating along the x-axis of coordinate system 806 (i.e., either from the +x direction or the −x direction), polar pattern 902-*y* is a figure-8 polar pattern that describes a directional audio signal representative of sound originating along the y-axis of coordinate system 806 (i.e., either from the +y direction or the −y direction), and polar pattern 902-*z* is a figure-8 polar pattern that describes a directional audio signal representative of sound originating along the z-axis of coordinate system 806 (i.e., either from the +z direction or the −z direction).

FIG. 9B illustrates a set of audio signals 904 (e.g., audio signals 904-*w* through 904-*z*) that are derived from the set of audio signals 808 illustrated in FIG. 8B and that collectively compose a first-order B-format signal. Audio signals 904 may implement or otherwise be associated with the directional capture patterns of polar patterns 902. Specifically, audio signal 904-*w* may be an omnidirectional audio signal implementing polar pattern 902-*w*, while audio signals 904-*x* through 904-*z* may each be figure-8 audio signals implementing polar patterns 902-*x* through 902-*z*, respectively. Collectively, this set of four audio signals 904 derived from audio signals 808 to align with coordinate system 806 may be known as an "B-format" signal. In particular, since audio signals 904 are all derived from the location-confined A-format signal of audio signals 808, the set of audio signals 904 may be referred to herein as a "location-confined B-format signal."

B-format signals such as the location-confined B-format signal composed of audio signals 904 may be advantageous in applications where sound directionality matters such as in virtual reality media content or other surround sound applications. This is because the audio coordinate system to which the audio signals are aligned (e.g., coordinate system 806) may be oriented to associate with (e.g., align with, tie to, etc.) a video coordinate system to which visual aspects of a virtual world (e.g., a virtual reality world) are aligned. As such, a B-format signal may be decoded and rendered for a particular user (i.e., person experiencing the virtual world by seeing the visual aspects and hearing the audio signals associated with the virtual world) so that sounds seem to originate from the direction that it appears to the user that the sounds should be coming from. Even as the user turns around within the virtual world to thereby realign himself or herself with respect to the video and audio coordinate systems, the sound directionality may properly shift and rotate around the user just as the video content shifts to show new parts of the virtual world the user is looking at.

In the example of FIGS. 9A and 9B, the B-format signal composed of audio signals 904 is derived from the A-format signal composed of four directional signals 808 of tetrahedral full-sphere multi-capsule microphone 710. Such a configuration may be referred to as a first-order Ambisonic microphone and may allow signals 904 of the B-format signal to approximate the directional sound along each respective coordinate axis with a good deal of accuracy and precision. However, in certain examples, it may be desirable to achieve an even higher degree of accuracy and precision with respect to the directionality of a B-format signal such as the location-confined B-format signal of audio signals 904. In such examples, full-sphere multi-capsule microphone 710 may include more than four capsules 802 that are spatially distributed in an arrangement associated with an Ambisonic microphone having a higher order than a first-order Ambisonic microphone (e.g., a second-order Ambisonic microphone, a third-order Ambisonic microphone, etc.). Rather than a tetrahedral arrangement, the more than four capsules 802 in such examples may be arranged in other geometric patterns having more than four corners, and may be configured to generate more than four audio signals to be included in a location-confined A-format signal from which a location-confined B-format signal may be derived.

In this way, the higher-order Ambisonic microphone may provide an increased level of directional resolution, precision, and accuracy for the location-confined B-format signal that is derived. It will be understood that above the first-order (i.e., four-capsule tetrahedral) full-sphere multi-capsule microphone 710 illustrated in FIGS. 8A and 9A, it may not be possible to obtain Ambisonic components directly with single microphone capsules (e.g., capsules 802). Instead, higher-order spherical harmonics components may be derived from various spatially distributed (e.g., omnidirectional) capsules using advanced digital signal processing techniques.

Returning to FIG. 7, it has now been described how full-sphere multi-capsule microphone 710 may capture ambient sound originating from various directions (e.g., from ambient sound sources 708) in and around capture zone 702 of real-world scene 704 in such a way that the captured ambient sound can be converted to a B-format signal to maintain the directionality of the sound when decoded (e.g., converted from a B-format signal into one or more renderable signals configured to be presented by a particular configuration of speakers) and rendered (e.g., presented or played back using the particular configuration of speakers) for a user. While this directionality may be important for certain applications (e.g., virtual reality media content, etc.), it may also be desirable for the sound rendered to the user to be location-diffused (rather than location-confined) for the reasons described above. Accordingly, it may be desirable to employ certain techniques for combining location-confined signals into location-diffused signals described herein (e.g., median filtering techniques and/or other techniques described above) to generate a location-diffused B-format signal that is based on both the 3D surround sound signal captured by full-sphere multi-capsule microphone 710 and the set of other audio signals captured by a plurality of microphones 706 (e.g., which may be implemented by single-capsule microphones and may also be referred to as single-capsule microphones 706) from various locations around capture zone 702.

To this end, system 600 may combine signals that are captured by (or that are derived from signals captured by) full-sphere multi-capsule microphone 710 with signals captured by single-capsule microphones 706 to form a location-diffused B-format signal in any way as may serve a particular implementation. For example, system 600 may employ a median filtering technique such as described above. Specifically, system 600 may generate a location-diffused B-format signal based on a location-diffused A-format signal that is generated by: 1) converting the set of audio signals 804 captured by full-sphere multi-capsule microphone 710 and the set of audio signals captured by single-capsule microphones 706 from a time domain into a frequency domain; 2) averaging magnitude and phase values derived from these two sets of audio signals while the sets of audio signals are in the frequency domain; 3) converting a set of frequency domain audio signals formed based on the averaging of the magnitude and phase values from a polar coordinate system to a cartesian coordinate system; and 4) converting the set of frequency domain audio signals from the frequency domain into the time domain to form a third set of audio signals included in the location-diffused A-format signal. More particularly, each frequency domain audio signal in the set of frequency domain audio signals may be based on the averaging of magnitude and phase values of a combination of audio signals that includes both a respective one of audio signals 808 in the set of audio signals 808, and all of the audio signals in the set of audio signals captured by single-capsule microphones 706.

Figure 10:
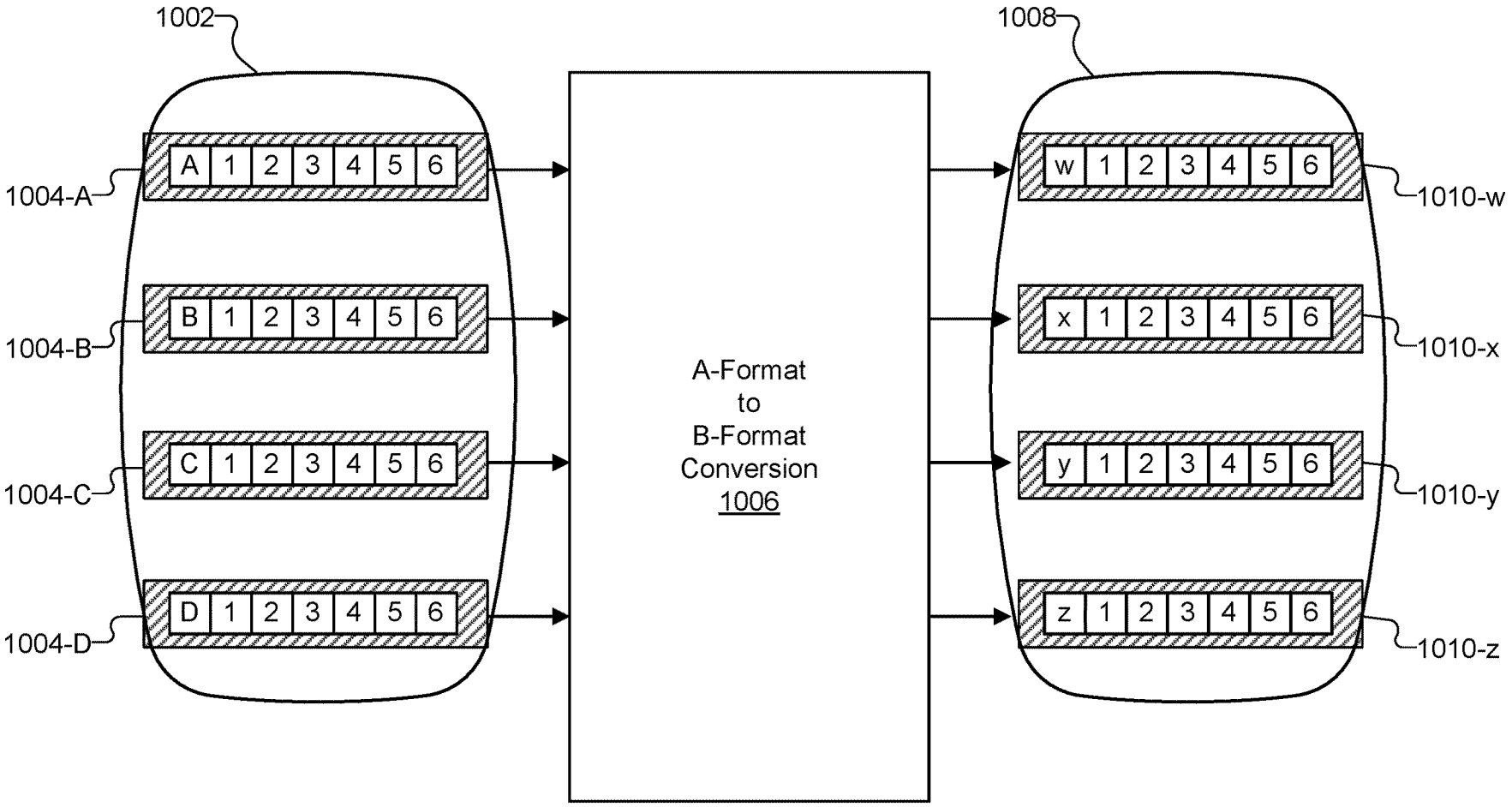
FIG. 10 illustrates a conversion of a location-diffused A-format signal into a location-diffused B-format signal representative of ambient sound according to principles described herein.

To illustrate, FIG. 10 shows a conversion of a location-diffused A-format signal into a location-diffused B-format signal representative of ambient sound (i.e., a location-diffused B-format signal). Specifically, a location-diffused A-format signal 1002 including a set of location-diffused audio signals 1004 (i.e., location-diffused audio signals 1004-A through 1004-D) is shown to undergo an A-format to B-format conversion process 1006 to result in a location-diffused B-format signal 1008 including another set of location-diffused audio signals 1010 (i.e., location-diffused audio signals 1010-*w* through 1010-*z*).

In FIG. 10, each individual location-diffused audio signal 1004 and 1010 is illustrated using a format described above in relation to FIG. 5. As such, it will be understood that, for example, location-diffused audio signal 1004-A is a location-diffused combination of audio signal 808-A from the set of audio signals 808 captured by full-sphere multi-capsule microphone 710 (represented by the box labeled "A") and all of the audio signals captured by single-capsule microphones 706 (represented by the boxes labeled "1" through "6"). Similarly, location-diffused audio signal 1004-B is a location-diffused combination of audio signal 808-B (represented by the box labeled "B") with all of the same audio signals captured by single-capsule microphones 706 as were combined in location-diffused audio signal 1004-A (again represented by the boxes labeled "1" through "6"). Location-diffused audio signals 1004-C and 1004-D also use this same notation.

By combining all of the audio signals captured by single-capsule microphones 706 with each of the four audio signals 808 captured by full-sphere multi-capsule microphone 710 in this way, location-diffused A-format signal 1002 may include an A-formatted representation of ambient sound captured not only at full-sphere multi-capsule microphone 710, but at all the single capsule microphones 706 distributed around capture zone 702. Accordingly, when the four first-order Ambisonic audio signals 1004 undergo A-format to B-format conversion process 1006, the resulting signals 1010 may form a B-formatted representation of the ambient sound captured both at full-sphere multi-capsule microphone 710 and at all of single-capsule microphones 706. Specifically, for example, location-diffused audio signal 1010-*w* may represent an omnidirectional signal representative of averaged overall sound pressure captured at all of the locations of microphones 710 and 706. Similarly, location-diffused audio signals 1010-*x* through 1010-*z* may each represent respective directional signals having figure-8 polar patterns corresponding to the respective coordinate axes of coordinate system 806, as described above. However, instead of including only the ambient sound captured by capsules 802 of full-sphere multi-capsule microphone 710, signals 1010 have further been infused with ambient sound captured from other locations around capture zone 702 (i.e., the locations of each of single-capsule microphones 706).

As a result, location-diffused B-format signal 1008 may be employed as an ambient sound channel for use in various applications. Advantageously, as a B-format signal, location-diffused B-format signal 1008 may include information associated with directionality of ambient sound origination so as to be decodable to generate renderable, full-sphere surround sound signals. At the same time, as a location-diffused signal, location-diffused B-format signal 1008 may serve as a fair representation of ambient sound for the entirety of capture zone 702, as opposed to being confined to a particular location within capture zone 702 (e.g., such as the location where full-sphere multi-capsule microphone 710 is disposed).

Figure 11:
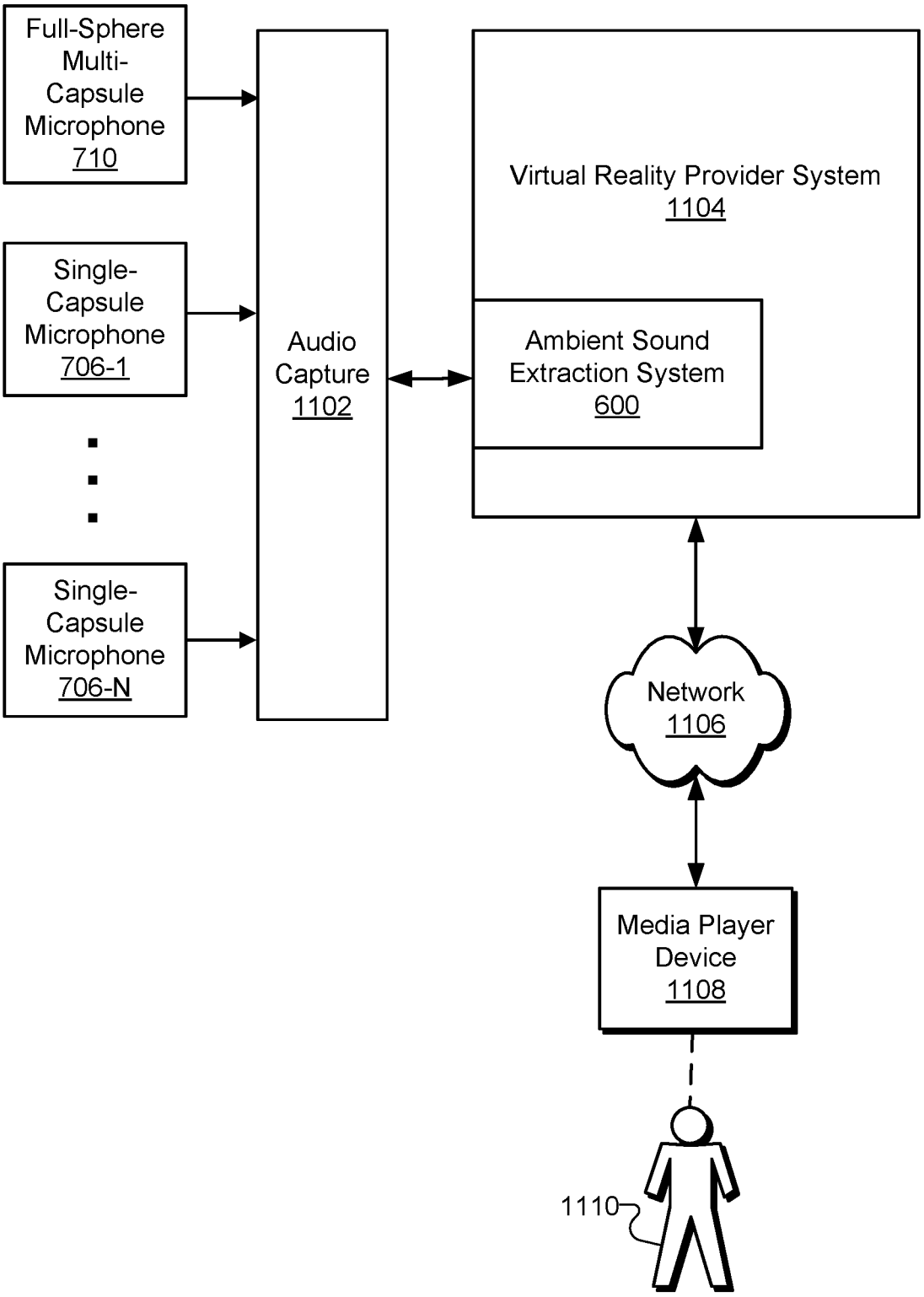
FIG. 11 illustrates an exemplary configuration in which the ambient sound extraction system of FIG. 6 may be implemented to provide ambient sound for presentation to a user experiencing virtual reality media content according to principles described herein.

To illustrate one particular application where an ambient sound channel such as location-diffused B-format signal 1008 may be employed, FIG. 11 shows an exemplary configuration in which system 600 may be implemented to provide ambient sound for presentation to a user experiencing virtual reality media content. As shown in FIG. 11, system 600 may access various audio signals (e.g., location-confined audio signals) from full-sphere multi-capsule microphone 710 and/or single-capsule microphones 706-1 through 706-N by way of an audio capture 1102. For example, as described above, audio capture 1102 may be integrated with system 600 (e.g., with signal capture facility 602) or may be composed of systems, devices (e.g., audio interfaces, etc.), and/or processes external to system 600 responsible for capturing, storing, and/or otherwise facilitating system 600 in accessing the audio signals captured by microphones 710 and 706.

As further shown, system 600 may be included within a virtual reality provider system 1104 that is connected via a network 1106 to a media player device 1108 associated with (e.g., being used by) a user 1110. Virtual reality provider system 1104 may be responsible for capturing, accessing, generating, distributing, and/or otherwise providing and curating virtual reality media content to one or more media player devices such as media player device 1108. As such, virtual reality provider system 1104 may capture virtual reality data representative of image (e.g., video) data and audio data (e.g., including ambient audio data) alike, and may combine this data into a form that may be distributed and used (e.g., rendered) by media player devices such as media player device 1108 to be experienced by users such as user 1110.

Such virtual reality data may be distributed using any suitable communication technologies included in network 1106, which may include a provider-specific wired or wireless network (e.g., a cable or satellite carrier network or a mobile telephone network), the Internet, a wide area network, a content delivery network, and/or any other suitable network or networks. Data may flow between virtual reality provider system 1104 and one or more media player devices such as media player device 1108 using any communication technologies, devices, media, and protocols as may serve a particular implementation.

As mentioned above, in some examples, virtual reality provider system 1104 may capture, generate, and provide (e.g., distribute) virtual reality data to media player device 1108 in real time. For example, virtual reality data representative of a real-world live event (e.g., a live sporting event, a live concert, etc.) may be provided to users to experience the real-world live event as the event is occurring. Accordingly, system 600 may be configured to generate both a location-diffused A-format signal and a location-diffused B-format signal representative of ambient sound in a capture zone in real-time as a location-confined A-format signal and a set of audio signals are being captured (e.g., by full-sphere multi-capsule microphone 710 and single-capsule microphones 706, respectively). As used herein, operations are performed "in real-time" when the operations are performed immediately and without undue delay. Thus, because operations cannot be performed instantaneously, it will be understood that a certain amount of delay (e.g., up to a few seconds or minutes) will necessarily accompany any virtual reality data that may be provided by virtual reality provider system 1104. However, if the operations to provide the virtual reality data are performed immediately such that, for example, user 1110 is able to experience a live event while the live event is still ongoing (albeit a few seconds or minutes delayed), such operations will be considered to be performed in real time.

System 600 may access audio signals and process the audio signals to generate an ambient audio channel such as location-diffused B-format signal 1008 in real time in any suitable way. For example, system 600 may employ an overlap-add technique to perform real-time conversion of audio signals from the time domain to the frequency domain and/or from the frequency domain to the time domain in order to generate a location-diffused A-format signal and/or to perform other real-time signal processing. The overlap-add technique may allow system 600 to avoid introducing undesirable clicking or other artifacts into a final ambient audio channel that is generated and provided as part of the virtual reality data distributed to media player device 1008.

Figure 12:
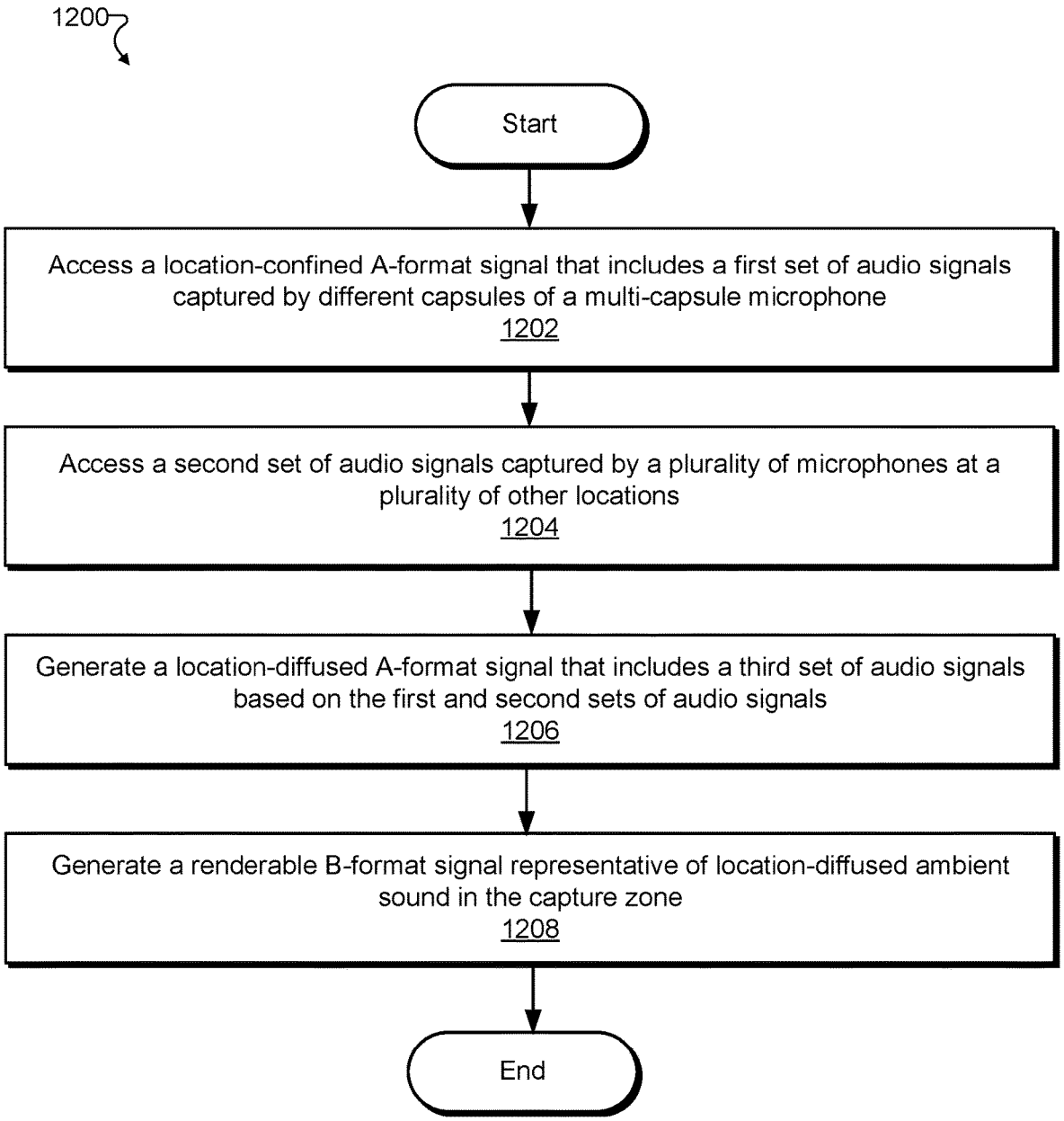
FIG. 12 illustrates an exemplary method for extracting location-diffused ambient sound from a real-world scene according to principles described herein.

FIG. 12 illustrates an exemplary method 1200 for extracting location-diffused ambient sound from a real-world scene. While FIG. 12 illustrates exemplary operations according to one embodiment, other embodiments may omit, add to, reorder, and/or modify any of the operations shown in FIG. 12. One or more of the operations shown in FIG. 12 may be performed by system 600, any components (e.g., multi-capsule microphones, single-capsule microphones, etc.) included therein, and/or any implementation thereof.

In operation 1202, an ambient sound extraction system may access a location-confined A-format signal. For example, the ambient sound extraction system may access the location-confined A-format signal from a full-sphere multi-capsule microphone disposed at a first location with respect to a capture zone of a real-world scene. The location-confined A-format signal may include a first set of audio signals captured by different capsules of the full-sphere multi-capsule microphone. Operation 1202 may be performed in any of the ways described herein.

In operation 1204, the ambient sound extraction system may access a second set of audio signals. For example, the ambient sound extraction system may access the second set of audio signals from a plurality of microphones disposed at a plurality of other locations with respect to the capture zone that are distinct from the first location. The second set of audio signals may be captured by the plurality of microphones. Operation 1204 may be performed in any of the ways described herein.

In operation 1206, the ambient sound extraction system may generate a location-diffused A-format signal that includes a third set of audio signals. For example, the third set of audio signals may be based on the first and second sets of audio signals accessed in operations 1202 and 1204, respectively. Operation 1206 may be performed in any of the ways described herein.

In operation 1208, the ambient sound extraction system may generate a location-diffused B-format signal representative of location-diffused ambient sound in the capture zone. For example, the location-diffused B-format signal may be based on the location-diffused A-format signal generated in operation 1206. Operation 1208 may be performed in any of the ways described herein.

In certain embodiments, one or more of the systems, components, and/or processes described herein may be implemented and/or performed by one or more appropriately configured computing devices. To this end, one or more of the systems and/or components described above may include or be implemented by any computer hardware and/or computer-implemented instructions (e.g., software) embodied on at least one non-transitory computer-readable medium configured to perform one or more of the processes described herein. In particular, system components may be implemented on one physical computing device or may be implemented on more than one physical computing device. Accordingly, system components may include any number of computing devices, and may employ any of a number of computer operating systems.

In certain embodiments, one or more of the processes described herein may be implemented at least in part as instructions embodied in a non-transitory computer-readable medium and executable by one or more computing devices. In general, a processor (e.g., a microprocessor) receives instructions, from a non-transitory computer-readable medium, (e.g., a memory, etc.), and executes those instructions, thereby performing one or more processes, including one or more of the processes described herein. Such instructions may be stored and/or transmitted using any of a variety of known computer-readable media.

A computer-readable medium (also referred to as a processor-readable medium) includes any non-transitory medium that participates in providing data (e.g., instructions) that may be read by a computer (e.g., by a processor of a computer). Such a medium may take many forms, including, but not limited to, non-volatile media, and/or volatile media. Non-volatile media may include, for example, optical or magnetic disks and other persistent memory. Volatile media may include, for example, dynamic random access memory ("DRAM"), which typically constitutes a main memory. Common forms of computer-readable media include, for example, a disk, hard disk, magnetic tape, any other magnetic medium, a compact disc read-only memory ("CD-ROM"), a digital video disc ("DVD"), any other optical medium, random access memory ("RAM"), programmable read-only memory ("PROM"), electrically erasable programmable read-only memory ("EPROM"), FLASH-EEPROM, any other memory chip or cartridge, or any other tangible medium from which a computer can read.

Figure 13:
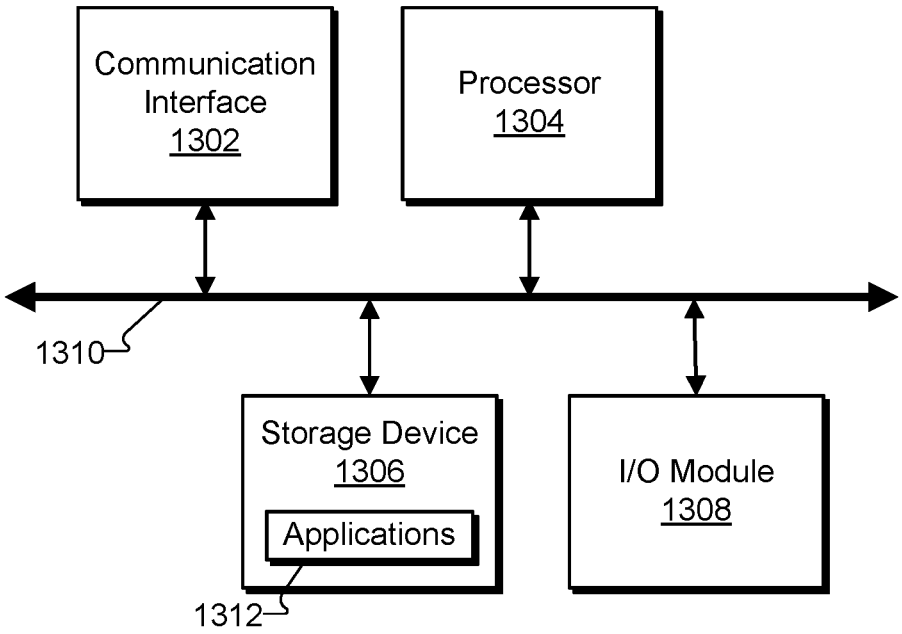
FIG. 13 illustrates an exemplary computing device according to principles described herein.

FIG. 13 illustrates an exemplary computing device 1300 that may be specifically configured to perform one or more of the processes described herein. As shown in FIG. 13, computing device 1300 may include a communication interface 1302, a processor 1304, a storage device 1306, and an input/output ("I/O") module 1308 communicatively connected via a communication infrastructure 1310. While an exemplary computing device 1300 is shown in FIG. 13, the components illustrated in FIG. 13 are not intended to be limiting. Additional or alternative components may be used in other embodiments. Components of computing device 1300 shown in FIG. 13 will now be described in additional detail.

Communication interface 1302 may be configured to communicate with one or more computing devices. Examples of communication interface 1302 include, without limitation, a wired network interface (such as a network interface card), a wireless network interface (such as a wireless network interface card), a modem, an audio/video connection, and any other suitable interface.

Processor 1304 generally represents any type or form of processing unit capable of processing data or interpreting, executing, and/or directing execution of one or more of the instructions, processes, and/or operations described herein. Processor 1304 may direct execution of operations in accordance with one or more applications 1312 or other computer-executable instructions such as may be stored in storage device 1306 or another computer-readable medium.

Storage device 1306 may include one or more data storage media, devices, or configurations and may employ any type, form, and combination of data storage media and/or device. For example, storage device 1306 may include, but is not limited to, a hard drive, network drive, flash drive, magnetic disc, optical disc, RAM, dynamic RAM, other non-volatile and/or volatile data storage units, or a combination or sub-combination thereof. Electronic data, including data described herein, may be temporarily and/or permanently stored in storage device 1306. For example, data representative of one or more executable applications 1312 configured to direct processor 1304 to perform any of the operations described herein may be stored within storage device 1306. In some examples, data may be arranged in one or more databases residing within storage device 1306.

I/O module 1308 may include one or more I/O modules configured to receive user input and provide user output. One or more I/O modules may be used to receive input for a single virtual reality experience. I/O module 1308 may include any hardware, firmware, software, or combination thereof supportive of input and output capabilities. For example, I/O module 1308 may include hardware and/or software for capturing user input, including, but not limited to, a keyboard or keypad, a touchscreen component (e.g., touchscreen display), a receiver (e.g., an RF or infrared receiver), motion sensors, and/or one or more input buttons.

I/O module 1308 may include one or more devices for presenting output to a user, including, but not limited to, a graphics engine, a display (e.g., a display screen), one or more output drivers (e.g., display drivers), one or more audio speakers, and one or more audio drivers. In certain embodiments, I/O module 1308 is configured to provide graphical data to a display for presentation to a user. The graphical data may be representative of one or more graphical user interfaces and/or any other graphical content as may serve a particular implementation.

In some examples, any of the facilities described herein may be implemented by or within one or more components of computing device 1300. For example, one or more applications 1312 residing within storage device 1306 may be configured to direct processor 1304 to perform one or more processes or functions associated with facilities 602 or 604 of system 600. Likewise, storage facility 606 of system 600 may be implemented by or within storage device 1306.

To the extent the aforementioned embodiments collect, store, and/or employ personal information provided by individuals, it should be understood that such information shall be used in accordance with all applicable laws concerning protection of personal information. Additionally, the collection, storage, and use of such information may be subject to consent of the individual to such activity, for example, through well known "opt-in" or "opt-out" processes as may be appropriate for the situation and type of information. Storage and use of personal information may be in an appropriately secure manner reflective of the type of information, for example, through various encryption and anonymization techniques for particularly sensitive information.

In the preceding description, various exemplary embodiments have been described with reference to the accompanying drawings. It will, however, be evident that various modifications and changes may be made thereto, and additional embodiments may be implemented, without departing from the scope of the invention as set forth in the claims that follow. For example, certain features of one embodiment described herein may be combined with or substituted for features of another embodiment described herein. The description and drawings are accordingly to be regarded in an illustrative rather than a restrictive sense.

What is claimed is:

1. A method comprising:

generating, by a sound extraction system, an averaged set of audio signals by averaging values derived from a first set of audio signals captured at a particular location with respect to a capture zone, and values derived from a second set of audio signals captured at different locations with respect to the capture zone; and generating, by the sound extraction system based on the averaged set of audio signals, a location-diffused signal representative of sound in the capture zone.

2. The method of claim 1, wherein the generating of the averaged set of audio signals includes:

converting the first and second sets of audio signals from a time domain into a frequency domain;

determining, while the first and second sets of audio signals are in the frequency domain, an average of a first value derived from a particular audio signal in the first set of audio signals and corresponding values derived from each of the audio signals in the second set of audio signals;

generating, based on the determined average of the first value and the corresponding values, an averaged frequency domain audio signal included in an averaged set of frequency domain audio signals; and converting the averaged set of frequency domain audio signals from the frequency domain into the time domain to form the averaged set of audio signals.

3. The method of claim 2, wherein the generating of the averaged set of audio signals further includes, prior to the converting of the averaged set of frequency domain audio signals from the frequency domain into the time domain, converting the averaged set of frequency domain audio signals from a polar coordinate system to a cartesian coordinate system.

4. The method of claim 1, wherein:

the generating of the averaged set of audio signals includes converting the first and second sets of audio signals from a time domain into a frequency domain;

the values derived from the first set of audio signals to be averaged with the values derived from the second set of audio signals are magnitude and phase values of the first set of audio signals; and the values derived from the second set of audio signals to be averaged with the values derived from the first set of audio signals are magnitude and phase values of the second set of audio signals.

5. The method of claim 4, wherein the averaging of the magnitude and phase values derived from the first set of audio signals and the magnitude and phase values derived from the second set of audio signals includes:

performing a median filtering of the magnitude values derived from the first and second sets of audio signals; and performing, independently from the median filtering of the magnitude values, a median filtering of the phase values derived from the first and second sets of audio signals.

6. The method of claim 1, wherein:

each audio signal in the first set of audio signals is captured by a different capsule of a multi-capsule microphone disposed at the particular location within the capture zone; and each audio signal in the second set of audio signals is captured by a different microphone disposed at one of the different locations with respect to the capture zone.

7. The method of claim 6, wherein:

the first set of audio signals captured by the multi-capsule microphone is included within a location-confined A-format signal;

the location-diffused signal generated based on the averaged set of audio signals is a location-diffused A-format signal;

the method further comprises generating, by the sound extraction system based on the location-diffused A-format signal, a location-diffused B-format signal representative of the sound in the capture zone and configured for use with virtual reality media content that is based on the capture zone and is renderable by a media player device.

8. The method of claim 6, wherein the multi-capsule microphone is a full-sphere multi-capsule microphone that includes four directional capsules in a tetrahedral arrangement, the four directional capsules configured to generate four audio signals in the first set of audio signals.

9. The method of claim 6, wherein the multi-capsule microphone is a full-sphere multi-capsule microphone that includes more than four capsules spatially distributed in an arrangement having a higher order than a first-order Ambisonic microphone, the more than four capsules configured to generate more than four audio signals in the first set of audio signals included in the location-confined A-format signal.

10. The method of claim 1, wherein:

the audio signals in the second set of audio signals are captured by a plurality of different microphones disposed at different locations with respect to the capture zone;

each of the microphones of the plurality of different microphones is a single-capsule omnidirectional microphone; and each of the different locations with respect to the capture zone at which the plurality of different microphones is located is within the capture zone of the real-world scene.

11. A system comprising:

a memory storing instructions; and a processor communicatively coupled to the memory and configured to execute the instructions to:

generate an averaged set of audio signals by averaging values derived from a first set of audio signals captured at a particular location with respect to a capture zone, and values derived from a second set of audio signals captured at different respective locations with respect to the capture zone; and generate, based on the averaged set of audio signals, a location-diffused signal representative of sound in the capture zone.

12. The system of claim 11, wherein the generating of the averaged set of audio signals includes:

converting the first and second sets of audio signals from a time domain into a frequency domain;

determining, while the first and second sets of audio signals are in the frequency domain, an average of a first value derived from a particular audio signal in the first set of audio signals and corresponding values derived from each of the audio signals in the second set of audio signals;

generating, based on the determined average of the first value and the corresponding values, an averaged frequency domain audio signal included in an averaged set of frequency domain audio signals; and converting the averaged set of frequency domain audio signals from the frequency domain into the time domain to form the averaged set of audio signals.

13. The system of claim 12, wherein the generating of the averaged set of audio signals further includes, prior to the converting of the averaged set of frequency domain audio signals from the frequency domain into the time domain, converting the averaged set of frequency domain audio signals from a polar coordinate system to a cartesian coordinate system.

14. The system of claim 11, wherein:

the generating of the averaged set of audio signals includes converting the first and second sets of audio signals from a time domain into a frequency domain;

the values derived from the first set of audio signals to be averaged with the values derived from the second set of audio signals are magnitude and phase values of the first set of audio signals; and the values derived from the second set of audio signals to be averaged with the values derived from the first set of audio signals are magnitude and phase values of the second set of audio signals.

15. The system of claim 14, wherein the averaging of the magnitude and phase values derived from the first set of audio signals and the magnitude and phase values derived from the second set of audio signals includes:

performing a median filtering of the magnitude values derived from the first and second sets of audio signals; and performing, independently from the median filtering of the magnitude values, a median filtering of the phase values derived from the first and second sets of audio signals.

16. The system of claim 11, wherein:

each audio signal in the first set of audio signals is captured by a different capsule of a multi-capsule microphone disposed at the particular location within the capture zone; and each audio signal in the second set of audio signals is captured by a different microphone disposed at one of the different locations with respect to the capture zone.

17. The system of claim 16, wherein:

the first set of audio signals captured by the multi-capsule microphone is included within a location-confined A-format signal;

the location-diffused signal generated based on the averaged set of audio signals is a location-diffused A-format signal;

the method further comprises generating, by the sound extraction system based on the location-diffused A-format signal, a location-diffused B-format signal representative of the sound in the capture zone and configured for use with virtual reality media content that is based on the capture zone and is renderable by a media player device.

18. The system of claim 16, wherein the multi-capsule microphone is a full-sphere multi-capsule microphone that includes four directional capsules in a tetrahedral arrangement, the four directional capsules configured to generate four audio signals in the first set of audio signals.

19. The system of claim 16, wherein the multi-capsule microphone is a full-sphere multi-capsule microphone that includes more than four capsules spatially distributed in an arrangement having a higher order than a first-order Ambisonic microphone, the more than four capsules configured to generate more than four audio signals in the first set of audio signals included in the location-confined A-format signal.

20. A non-transitory computer-readable medium storing instructions that, when executed, direct a processor of a computing device to:

generate an averaged set of audio signals by averaging values derived from a first set of audio signals captured at a particular location with respect to a capture zone, and values derived from a second set of audio signals captured at different respective locations with respect to the capture zone; and generate, based on the averaged set of audio signals, a location-diffused signal representative of sound in the capture zone.

* * * * *